US007246728B2

(12) United States Patent
Nottingham et al.

(10) Patent No.: US 7,246,728 B2
(45) Date of Patent: Jul. 24, 2007

(54) CONTAINER AND LID ASSEMBLY

(75) Inventors: John R. Nottingham, Bratenahl, OH (US); John W. Spirk, Gates Mills, OH (US); Dale A. Panasewicz, Strongsville, OH (US); Robert Iredell, Cleveland Heights, OH (US); Nick E. Stanca, Westlake, OH (US)

(73) Assignee: The Sherwin-Williams Company, Cleveland, OH (US)

( * ) Notice: Subject to any disclaimer, the term of this patent is extended or adjusted under 35 U.S.C. 154(b) by 0 days.

(21) Appl. No.: 11/095,253

(22) Filed: Mar. 31, 2005

(65) Prior Publication Data

US 2005/0247744 A1 Nov. 10, 2005

Related U.S. Application Data

(60) Provisional application No. 60/557,860, filed on Mar. 31, 2004, provisional application No. 60/603,226, filed on Aug. 20, 2004.

(51) Int. Cl.
*B65D 5/72* (2006.01)

(52) U.S. Cl. ..... 222/568; 220/366.1

(58) Field of Classification Search ..... 222/568, 222/142.7, 142.8, 147–151, 533, 628, 189.1, 222/189.09, 189.08, 189.11, 319, 383.1, 519–525, 222/402.22, 402.23; 239/289, 346, 353, 239/302, 106, 107; 215/307–311, 229, 274; 220/705, 254.1, 254.2, 254.8, 366.1, 367.1
See application file for complete search history.

(56) References Cited

U.S. PATENT DOCUMENTS 2,002,635 A 5/1935 Kinney
3,398,427 A 8/1968 John
3,554,659 A 1/1971 Stokes
4,175,300 A 11/1979 McGlew et al.
4,220,285 A * 9/1980 Gualdi ..... 239/309
4,235,377 A * 11/1980 Davis et al. ..... 239/215
4,431,326 A 2/1984 Braithwaite et al.
4,550,919 A 11/1985 Snetting et al.

(Continued)

FOREIGN PATENT DOCUMENTS

FR 2085516 A 12/1971

OTHER PUBLICATIONS

PCT International Search Report for International Application No. PCT/US05/10902, mailed Nov. 23, 2005.

(Continued)

*Primary Examiner*—Lien M. Ngo
(74) *Attorney, Agent, or Firm*—Eryn Ace Fuhrer; Robert E. McDonald; Calfee, Halter & Griswold, LLP

(57) ABSTRACT

An assembly for facilitating the use of paint applicator accessories in connection with a plastic container is provided. The assembly includes a nozzle device housed within a container lid and having a suction line, which extends into the paint container. The assembly also includes one or more vent holes. The assembly can be used to supply paint to a paint applicator device by attaching an intake conduit of the paint applicator to the nozzle device. As paint is siphoned out of the container by the applicator device, the vent holes allow air to flow into the container to replace the volume of withdrawn paint.

5 Claims, 20 Drawing Sheets

U.S. PATENT DOCUMENTS

| | | | | | |
|---|---|---|---|---|---|
| 4,552,477 | A | | 11/1985 | Braithwaite et al. | |
| 4,576,553 | A | | 3/1986 | Winston et al. | |
| 4,583,876 | A | | 4/1986 | Karliner et al. | |
| 4,597,684 | A | | 7/1986 | O'Brien et al. | |
| 4,695,176 | A | | 9/1987 | Simonette et al. | |
| 4,723,564 | A | | 2/1988 | West et al. | |
| 4,732,503 | A | | 3/1988 | Bader et al. | |
| 4,760,962 | A | * | 8/1988 | Wheeler | 239/289 |
| 4,824,272 | A | | 4/1989 | Collins et al. | |
| 5,102,045 | A | | 4/1992 | Diana | |
| 5,370,272 | A | * | 12/1994 | Gueret | 222/95 |
| 5,494,199 | A | | 2/1996 | Anderson et al. | |
| 5,497,945 | A | | 3/1996 | Steinberg et al. | |
| 5,638,994 | A | | 6/1997 | Libit et al. | |
| 5,655,714 | A | | 8/1997 | Kieffer et al. | |
| 5,806,573 | A | * | 9/1998 | Kilcoin | 141/21 |
| 5,904,434 | A | | 5/1999 | Bekius et al. | |
| 5,935,659 | A | | 8/1999 | Cane et al. | |
| 6,213,358 | B1 | | 4/2001 | Libit et al. | |
| 6,257,455 | B1 | * | 7/2001 | Trepina et al. | 222/189.09 |
| 6,332,564 | B2 | * | 12/2001 | Ichikawa | 222/464.1 |
| 6,434,782 | B2 | | 8/2002 | Wakat et al. | |
| 6,634,525 | B2 | * | 10/2003 | Bravo et al. | 222/143 |
| 6,824,072 | B2 | * | 11/2004 | Minder | 239/104 |
| 6,983,862 | B2 | | 1/2006 | Nottingham et al. | |
| 2004/0026450 | A1 | * | 2/2004 | Rohr et al. | 222/109 |
| 2005/0056652 | A1 | * | 3/2005 | Cezeaux | 220/709 |

OTHER PUBLICATIONS

Written Opinion of the International Searching Authority for International Application No. PCT/US05/10902, mailed Nov. 23, 2005.

International Preliminary Report on Patentability for International Application No. PCT/US05/10902, mailed Jun. 15, 2006.

* cited by examiner

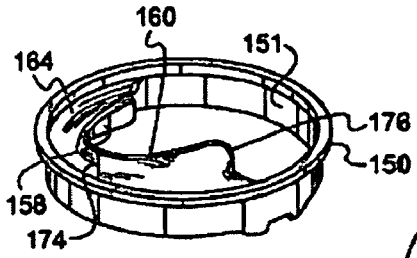
FIG. 7
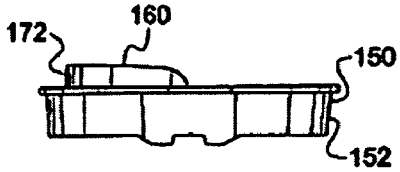
FIG. 8
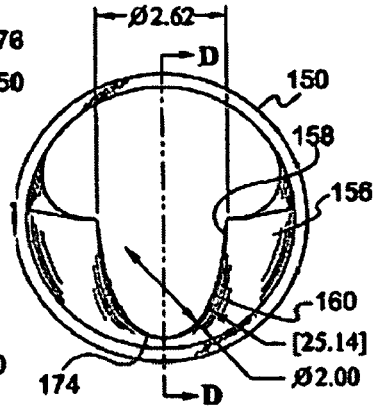
FIG. 9
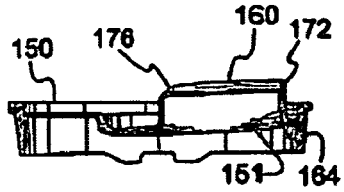
FIG. 10
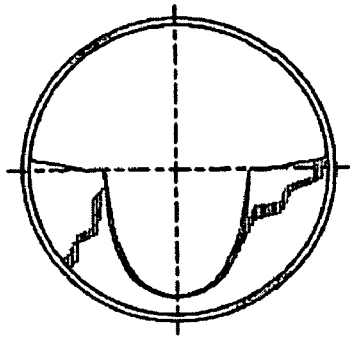
FIG. 11
FIG. 12
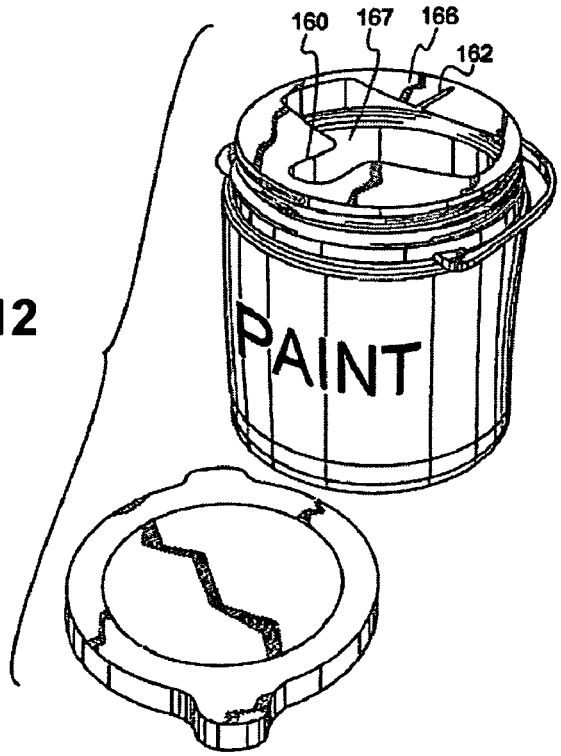

CONTAINER AND LID ASSEMBLY

RELATED APPLICATION DATA

This application claims priority from U.S. Provisional Application No. 60/557,860 filed Mar. 31, 2004, and U.S. Provisional Application No. 60/603,226 filed on Aug. 20, 2004. The disclosures of both Provisional Applications 60/557,860 and 60/603,226 are hereby incorporated by reference. In addition, this application is related to U.S. patent application Ser. No. 10/126,481 filed Apr. 18, 2002, which claims priority from U.S. Provisional Application No. 60/284,476 filed Apr. 18, 2001 and U.S. Provisional Application No. 60/292,364 filed on May 21, 2001, all of which are hereby incorporated by reference.

TECHNICAL FIELD

This application relates generally to paint containers and accessories for use therewith, and more specifically to a lid assembly for a paint container which accommodates paint container accessories which remove paint from the container for application.

BACKGROUND

The most common way to store paints or other coatings has been within circular metal cans having removable metal lids. In use, the lid is removed using a prying tool, the paint is stirred and then poured from the can. Alternatively a brush is dipped directly into the can for applying paint to a surface. Most metal cans, such as steel paint cans, are moved and carried using a bail handle made from a steel wire which is mounted in bosses on opposite sides of the container.

Traditional metal paint cans have numerous drawbacks. First, removal of the lid requires a prying tool and can be difficult. Replacement of the lid may also be difficult because a hammer or mallet is often required to completely reseat opposed mating grooves on the lid and container and to effectively seal the container. Alternatively, individuals sometimes step on the top of the can to press the lid into place. This practice may be hazardous if one loses their balance, and messy when paint remains in the container grooves as a result of the pouring process.

Over time, due to the moisture inherent within the paint, metal pails and lids have a tendency to rust or corrode. If rust pieces fall into the paint, they often render the paint useless. Metal paint cans are also susceptible to impact damage when they are dropped, or impacted from the side. Once the can is deformed, seating and reseating the lid can be difficult and it is difficult and often impossible to return the can to a desired shape.

Pouring paint from metal paint cans is yet another difficult task due to the can's configuration. Flowing paint is difficult to guide because no spout formation exists upon the can. Paint usually runs down the side of the can and fills to container grooves in the lid seat area. The result is a messy container, which is difficult to open upon next use. Manufacture of paint cans has also been difficult. The formation and attachment of metal wire bail handles is a difficult task to perform.

Various types of applicators have been developed to simplify and accelerate the painting process. For instance, roller applicators have been developed which hold a supply of paint in a cylindrical handle attached to the roller. In addition, powered sprayers and rollers have also become popular. However, pouring paint from conventional containers for use in these types of applicators can be messy.

In one type of roller applicator, paint is delivered from the handle to the roller by a piston, which exerts force on the fluid in the handle reservoir for application on a surface. For convenience, these applicators are equipped with an intake valve, which can be attached to a tube that is positioned in a bucket or can of paint. Retraction of the piston in the cylindrical handle creates a vacuum and draws paint through the tubes and into the handle reservoir. Examples of such rollers are disclosed in U.S. Pat. Nos. 4,732,503, 3,554,659, 4,824,272 and 4,695,176, all of which are hereby incorporated by reference. Powered sprayers, rollers or brushes are also popular for applying paint. Some sprayers are equipped with a paint cup into which paint from the can is poured for application. However, in other cases, a larger supply of paint is needed for powered sprayers or rollers. In these cases, it is often desirable to pump paint directly from the original container for application with the sprayer or roller. Such powered sprayers, rollers or brushes employ a pump, air compressor or similar device to draw or force paint out of a reservoir through and into a conduit communicating with the applicator. Examples of such powered applicators are shown in U.S. Pat. Nos. 5,494,199, 4,175,300, and 4,904,434, which are hereby incorporated by reference. Special tops for metal paint cans have been developed to facilitate the transfer of paint from the can to applicator devices, such as those described above. Typically these involve a sealing cover, which is positioned over the top of a paint can as shown in U.S. Pat. Nos. 4,175,300 and 4,695,176. A tube extending through the lid is attached to the applicator device so that paint may be siphoned out of the container and into the applicator.

In light of the advent of improved paint containers as are described herein, there exists a need for a need for ways to use applicator devices, which draw paint directly from a container, in connection with such new containers.

SUMMARY OF THE INVENTION

The present application provides an improved plastic container and lid assembly for storing liquid and coating materials. The assembly includes a container and a lid. The container has a body with a bottom wall, a sidewall and a neck. The sidewall may be a circular cross sectional configuration, or a rectangular configuration, in which case, at least four sidewalls are provided. Where four sidewalls are provided, the distance between one sidewall and an opposite sidewall is equal to the diameter of a conventional one gallon metal paint can or a conventional one quart metal paint can, depending on the size of the assembly. Moreover, the effective volume of the assembly is identical to that of a conventional paint can, such that the assembly of the present application may readily replace conventional paint cans.

The neck defines a wide mouth opening which includes threads for receiving mating threads on the lid. The threads are preferably a double helix to provide for specific alignment of the lid with respect to the container body. The double helix thread on the lid engages the neck threads such that the sealing engagement of the double helix thread is provided on the neck threads after between ½ to ¾ of one revolution.

The lid has two or four lugs extending radially from opposite sides of said lid. The lugs terminate at or before the lugs extend beyond the container sidewall(s) when the lid is in sealed engagement with the container. The body may also include an integral handle for lifting the container. A second handle may also be provided. The second handle may be a bail-type handle supported on the container neck also for lifting the container. The integral handle and bail-type handle do not extend beyond said container sidewall. Thus, the container and lid assembly have a footprint which substantially conforms to the footprint of a conventional metal paint can. In the preferred embodiment, where four sidewalls are joined and define four corners, the lugs are aligned over the corners when the lid is in sealed engagement with the container.

The integral handle included in the container body may be hollow, and is formed at one of the four corners of the container. When the lid is in sealed engagement on the container, one of the lugs is aligned over the integral handle. The integral handle forms a hollow vertical pillar within the body at the one corner of the body, with the pillar defining a cavity extending from one sidewall to an adjacent sidewall. The alignment of the lugs of the lid and bail-type handle over the corners of the container, within the boundaries of the sidewalls of the container during sealing engagement of the lid on the container, also facilitates the replacement of conventional metal paint cans by the present assembly. When all elements of the assembly are aligned within the boundary of the sidewalls, the effective packing footprint of the assembly is substantially equal to that of a conventional paint can.

A lid and suction assembly for facilitating use of paint applicator accessories with a container as described herein is also provided. The lid/suction assembly comprises in combination a hole and a vent in the container lid. In one embodiment, the lid has a recessed opening therethrough. A nozzle device including a fill tube and one or more vent holes is positioned in the opening. The nozzle device is adapted to receive a cap to seal the container when the lid/suction assembly is positioned thereon. In order to remove paint from the container through the lid/suction assembly, a suction line extends downwardly from the nozzle device into the container to siphon paint out of the container when attached to a paint applicator device. The suction line may also include a filter to remove any dried paint particles or other solids from the paint being siphoned through the suction line and fill tube to a paint applicator.

Additionally, a method of storing the assembly is also provided wherein four containers are placed upon a pallet or within a box with the integral handle of each container oriented towards the exterior of the pallet or box.

These and other features and advantages of the present invention will become apparent from the following figures and detailed description.

BRIEF DESCRIPTION OF THE DRAWINGS

FIG. 7 shows a perspective view of one embodiment of a container pouring insert;

FIG. 8 shows a side view of the container pouring insert;

FIG. 9 shows a top view of the container pouring insert;

FIG. 10 shows a cutaway view of the container pouring insert;

FIG. 11 shows a top view of an alternate container pouring insert embodiment;

FIG. 12 shows an alternative embodiment of a container pouring insert;

DETAILED DESCRIPTION OF THE INVENTION

Figure 1:
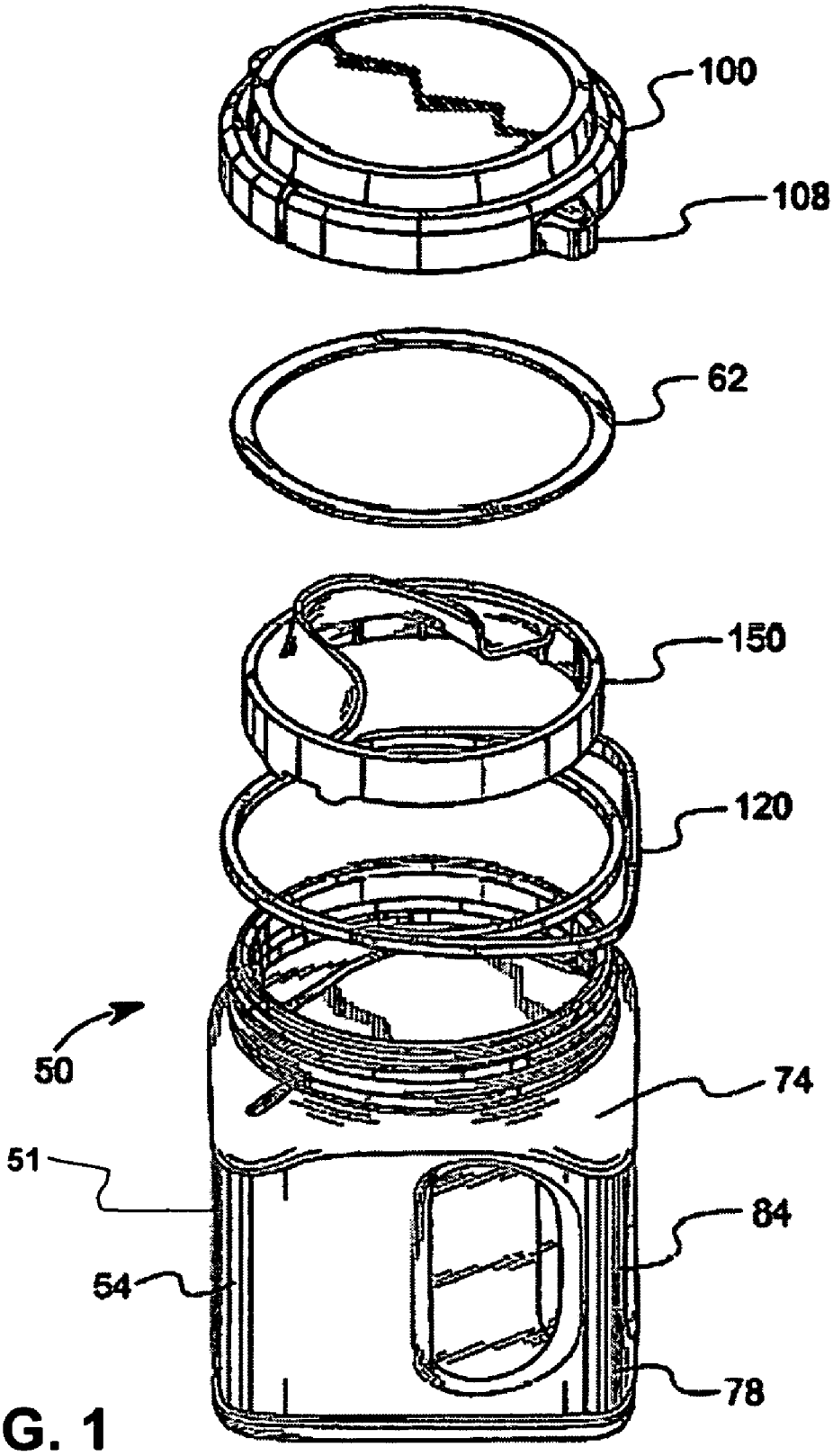
FIG. 1 shows an exploded view of a container of the present invention.

It will be appreciated that the illustrated boundaries of elements (e.g., boxes or groups of boxes) in the figures represent one example of the boundaries. One of ordinary skill in the art will appreciate that one element may be designed as multiple elements or that multiple elements may be designed as one element. An element shown as an internal component of another element may be implemented as an external component and vice versa.

Further, in the accompanying drawings and description that follow, like parts are indicated throughout the drawings and description with the same reference numerals, respectively. The figures are not drawn to scale and the proportions of certain parts have been exaggerated for convenience of illustration.

Referring to FIG. 1, a schematic view of the components of the container 50 and lid 100 assembly is shown. The assembly comprises a container 50 having an integral handle 84, a bail handle 120, a pouring insert 150, and a lid 100 having lugs 108.

Figure 4:
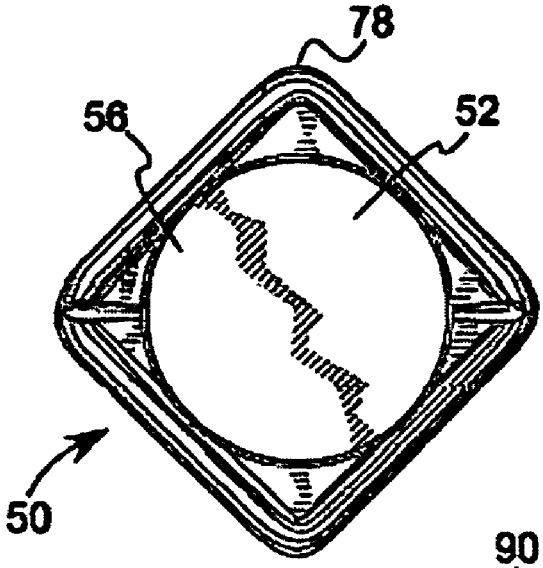
FIG. 4 shows a bottom view of a container.
Figure 5:
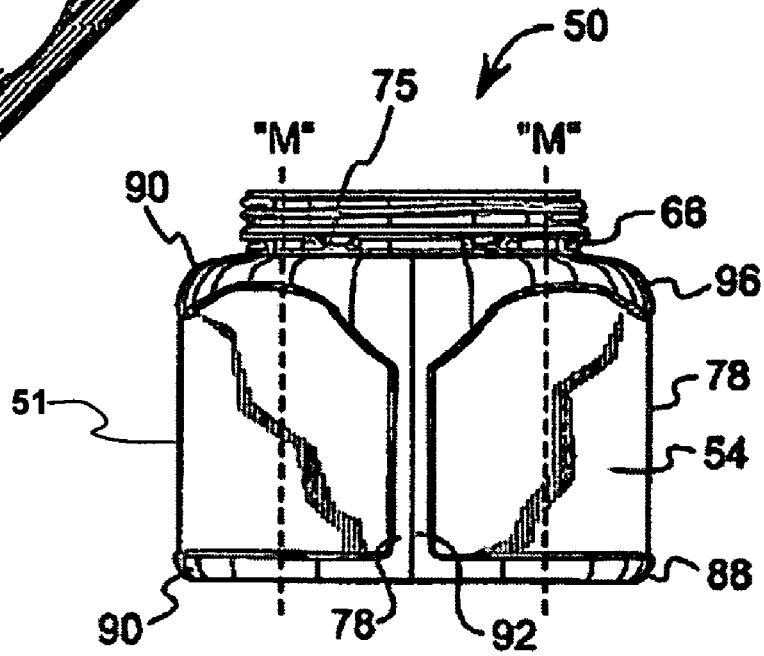
FIG. 5 shows a side view of a container.
Figure 6:
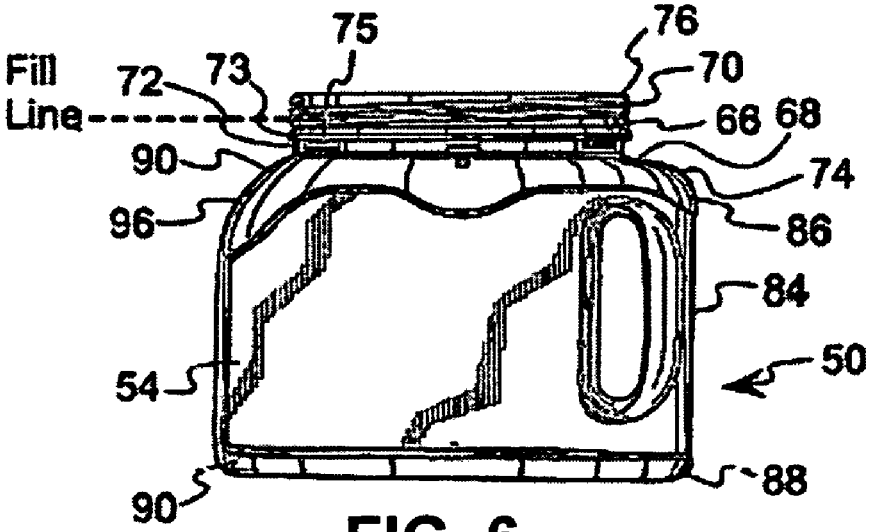
FIG. 6 shows an alternate side view of a container.
Figure 33:
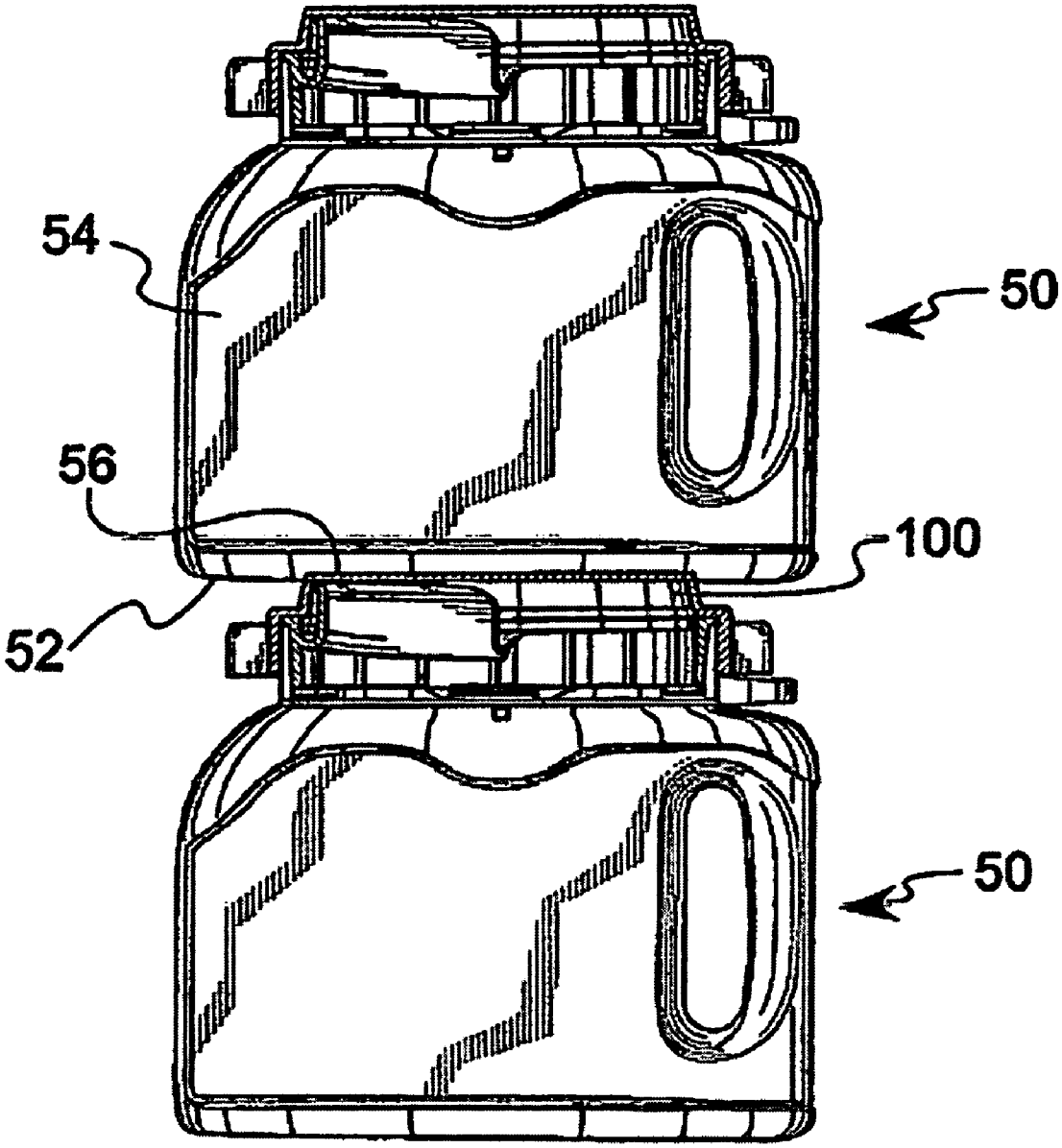
FIG. 33 shows two containers in stacked configuration.
Figure 34:
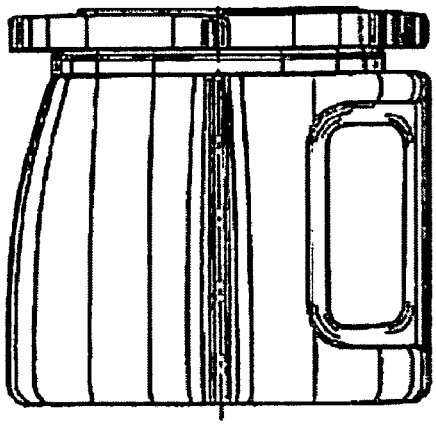
FIGS. 34–37 show various alternate container and lid configuration embodiments.

Referring to FIGS. 4, 5 and 6, the container 50 comprises a body 51, bottom wall 52, sidewall(s) 54, a neck 66, and one or more handles 84. In the illustrated embodiment the bottom wall 52 is square, but in other embodiments may be rectangular or circular. The body 51 is one piece and is preferably made from any polymer material which can be blow molded, for example, high density polyethylene (HDPE) or polypropylene. Use of these materials, as well as the design of the container 50, result in the container suffering a lesser amount of damage when dropped from a height of about 48 inches or about 120 cm, as compared to a conventional paint can dropped from an equivalent height. The reduction in damage reduces the number of containers returned to the manufacturer due to shipping or other damage making the product undesirable to consumers. The bottom wall 52 functions as the base of the container 50, providing stability when placed upon a flat surface. The bottom wall 52 may include an indentation 56. As illustrated in FIG. 33, the indentation 56 has a shape similar to the shape of the lid 100 so that the lid 100 of one container 50 mates with the bottom wall 52 of a second container 50 when multiple containers are stacked.

Figure 29:
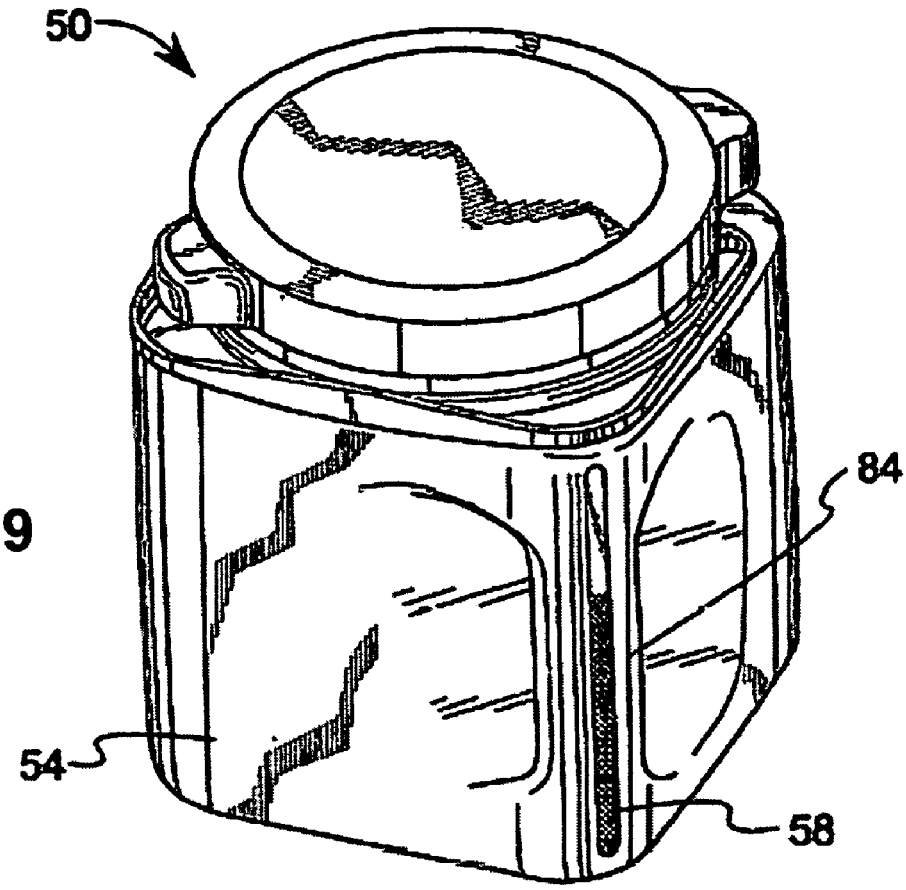
FIG. 29 shows a container with a fluid level indicator.

The bottom wall 52 of the body 51 is integrally formed with the sidewalls 54 of the container 50. Referring to FIG. 1, the body 51 illustrated includes four sidewalls 54. The sidewalls 54 may be wholly or partially formed from a transparent material, such as polyethylene terephthalate (PET). The transparent material permits the liquid within the container to be observed. FIG. 29 shows a container 50 including a narrow band 58 of transparent material in the handle 84 to allow fluid level to be observed. The container 50 may additionally include graduations which allow the level of liquid remaining within the container 50 to be quantified.

Figure 2:
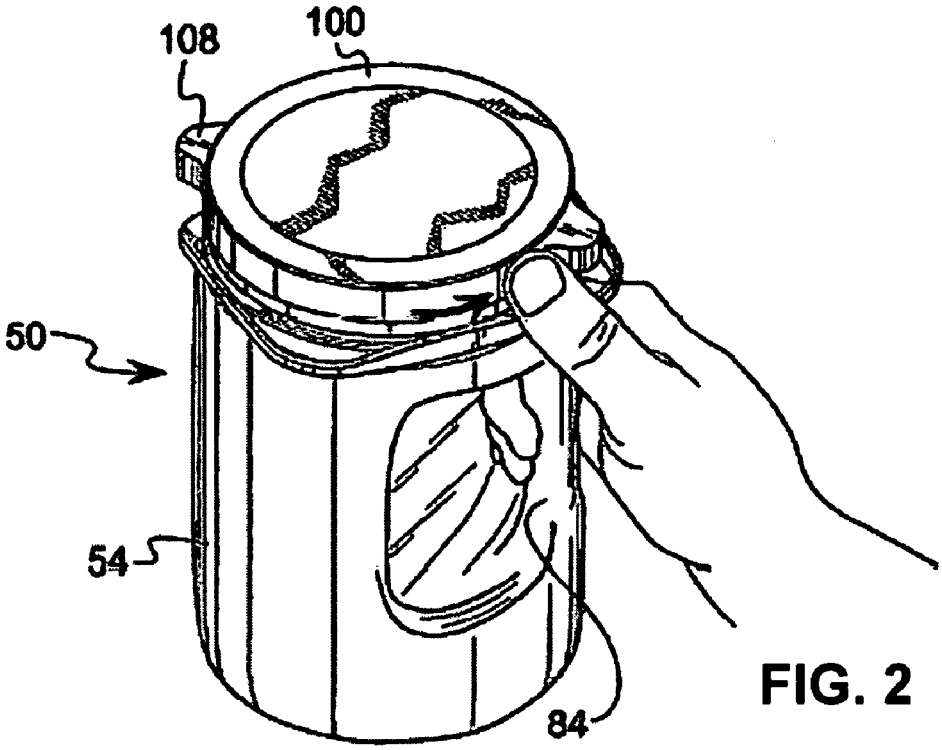
FIG. 2 shows a "no-tool" method of lid removal from a container of the present invention.

The number and shape of the sidewalls 54 depend upon the overall shape of the container 50. A round container 50, as shown in FIG. 2 includes a single sidewall 54 while a rectangular container 50 shown in FIG. 1 includes four sidewalls 54. The sidewalls 54 illustrated in FIG. 1 have a flat smooth surface. Alternatively, the sidewalls 54 may be slightly contoured and somewhat roughened or textured, as illustrated in FIG. 5, to facilitate the application of labels and the like and simplify a method of blow molding the sidewalls 54. In a rectangular shaped embodiment with more than one sidewall 54, each sidewall 54 meets an adjacent sidewall 54 at a corner 78. The rectangular shaped embodiment provides increased visibility for labels attached to sidewalls 54 as compared to a conventional cylindrical paint can. Such increased visibility provides sales and marketing advantages, as the consumer is more readily able to read and review the material provided on a flat container label.

The corners 78 in the illustrated embodiment are preferably rounded for increased strength, which may be required when the filled containers 50 are compressed during stacking. Additionally, while the corners are rounded, the amount of rounding cannot be so great as to decrease the required volume of the container. Where the container 50 is for replacement of a conventional paint can which holds one (1) gallon of paint, the container requires a volume of at least 139 ounces, which provides for some head space between the fluid level and lid 100. In the preferred embodiment, each corner 78 may be rounded to a radius of approximately 0.75 inches (19 mm).

Figure 20:
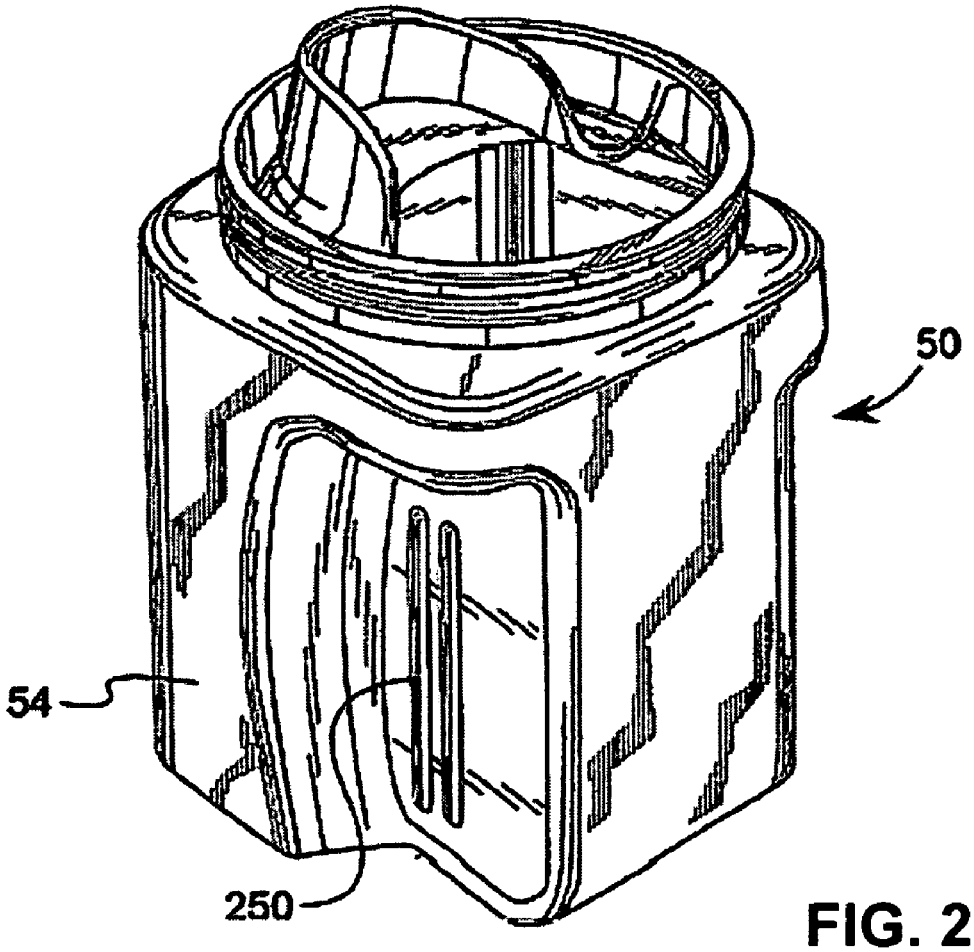
FIG. 20 shows an alternate embodiment of an integral handle of a container of the present application.

Additionally, the sidewalls 54 illustrated in FIGS. 5 and 6 are also recessed, such that the top and bottom portions 86 and 88 of the container 50 which include rounded corners that form horizontally strengthening ribs 90. The ribs 90 horizontally surround the top and bottom portions 86 and 88. Additionally, a vertical rib 92 may be provided between the top and bottom portions 86 and 88. FIG. 5 shows an exteriorly projecting rib along the corner opposite an integral handle 84. FIG. 20 shows numerous interiorly projecting ribs 94 on a container 50. Interiorly projecting ribs 94 add strength to the container 50 and aid in the fluid mixing process by breaking up fluid streams along the sidewalls 54 of the container 50. The corner 96 opposite the integral handle 84 in the FIG. 6 container embodiment may be contoured with a lower profile to avoid becoming a barrier or interference to liquid as it is being poured from the container 50. In the rectangular embodiments of the present application, each sidewall 54 also has an imaginary middle line "M" which extends from the top of the sidewall 54 to the bottom of the sidewall 54. The middle line "M" is positioned equidistant from each corner 78 of the sidewall 54. When the lid 100 of the container 50 is screwed into a sealed position, the lugs 108 of the lid 100 may be aligned with the corners 78 between the sidewalls 54 or the middle lines "M" of a sidewall 54, depending on the embodiment.

Figure 19:
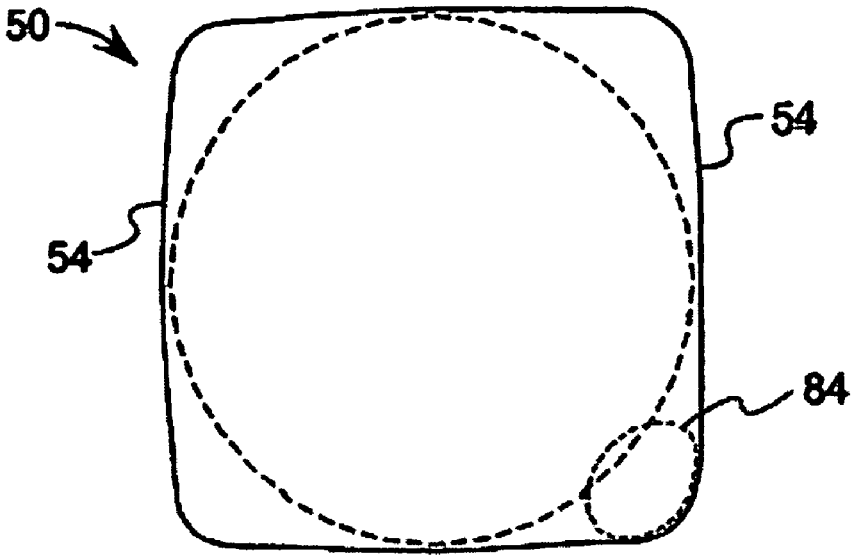
FIG. 19 shows the footprint of the container of the present invention, as compared to a conventional paint can.

Referring to FIG. 19, the container of present application is preferably sized to easily replace conventional cylindrical metal paint cans due to its substantially equal effective packing volume. The effective packing volume includes the effective packing "footprint" (a function of width and depth) of the container, as well as the effective packing height of the container, and is comparable to the footprint and height of a conventional metal paint can. The effective packing volume is a product of effective packing footprint times the effective packing height. The effective packing volume is important for aspects of manufacture, manipulation, storage, and use of the present container as a substitute for a conventional metal paint can. With a substantially equal packing volume, the present container may often be handled in conventional machinery, as well as packed, filled, labeled, shipped, displayed, handled, and used in ways which are conventional and currently in use by manufacturers, retailers and consumers. Embodiments of the container 50 "match" the effective packing volumes of conventional paint cans which hold one gallon or one quart, as well as metric sized cans which are standard in Europe and other parts of the world. The dimensions of a conventional one gallon cylindrical paint can, having a circular cross section, are approximately a height of 7.68 inches and a diameter of approximately 6.63 inches. The circular cross section of the conventional can may be inscribed within the cross section of the rectangular container 50 embodiment of the present application, resulting in substantially equal effective packing footprints. The depth and width of the rectangular container embodiment are substantially equal to the diameter of the conventional cylindrical can, providing a one quarter inch margin for manufacturing tolerances. The effective packing height, which is equal to the height of the container and lid assembly combination, of the rectangular container embodiment will likewise be substantially equal and within one quarter inch of the effective packing height of the conventional can and lid. Thus, for example, despite the very different geometry of the container 50 and its integral handle 84, the container holds an amount of material which is identical to the amount conventional cylindrical metal can may hold—one gallon—while leaving sufficient "head space" between the lid 100 and the fluid material within container 50 in each. The effective packing volume is also substantially equal. With a substantially equal packing volume as compared to a conventional can, the container 50 of this application may readily replace conventional cans.

Figure 13:
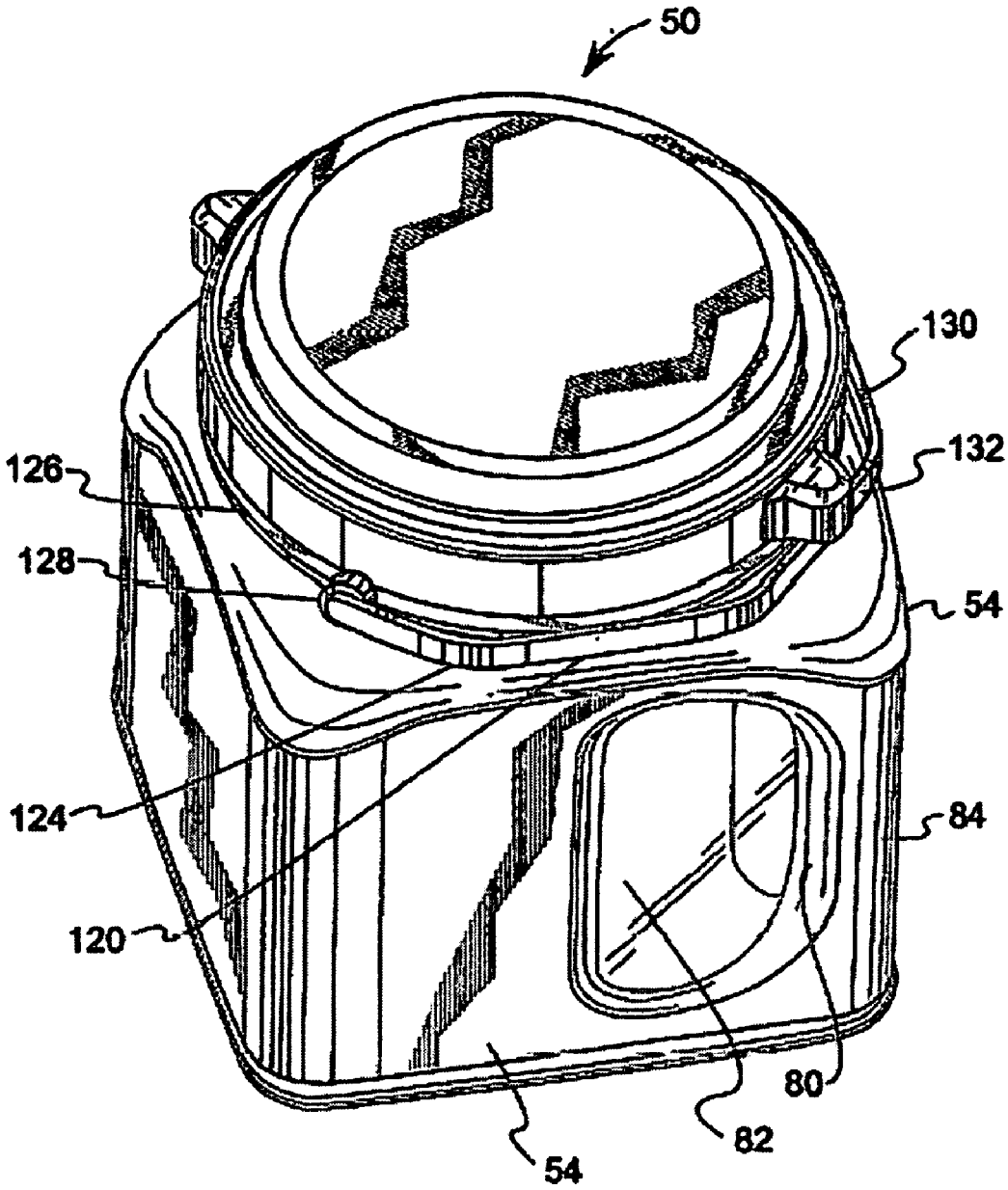
FIG. 13 shows a perspective view of a container with an embodiment with a two-piece bail-type handle.

The illustrated container 50 of FIGS. 1–5 and 13 includes an integral handle 84. The integral handle 84 may be a vertical pillar within the container and formed on one corner 78 of the container 50. The integral handle 84 may be hollow or solid, but is preferably hollow to facilitate mixing of the liquid within the container 50. Like the container 50, the handle 84 may be wholly or partially transparent. The handle 84 is sized to allow comfortable gripping by a variety of consumers. The handle 84 greatly adds to the overall strength of the container 50, particularly with respect to vertical loads. The handle 84 is rounded in cross-section for comfortable handling. Referring to FIG. 13, the handle 84 includes an interior face 80 which defines part of a cavity extending from one sidewall 54 to an adjacent sidewall 54. The cavity is also formed by an interior wall 82 extending from one sidewall 54 to an adjacent sidewall 54. The illustrated interior wall 82 is planer.

Figure 21:
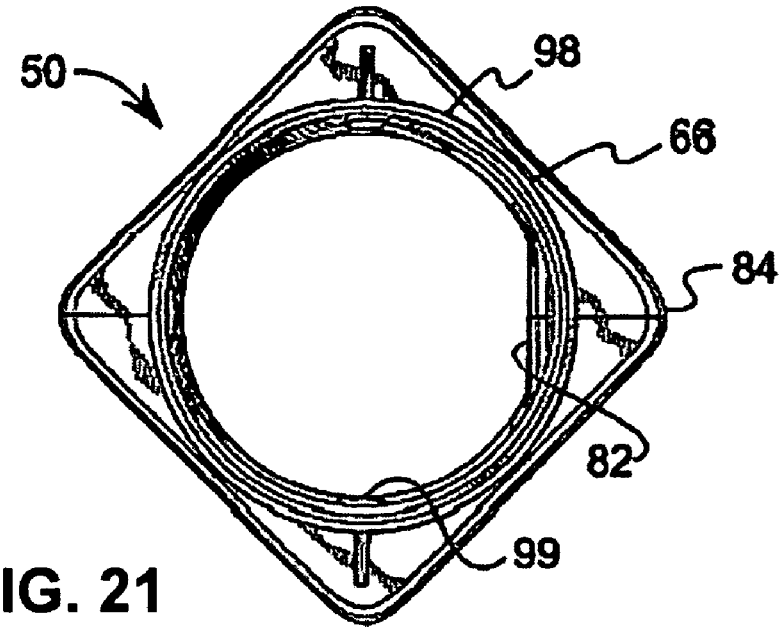
FIG. 21 shows a top view of an open container of the present invention.

As shown in FIG. 21, the neck 66 of the container defines a wide mouth opening which has a diameter which is so large that the interior wall 82 extends into the diameter of the wide mouth opening. The integral handle 84 may be used in conjunction with or as a replacement for a second handle of a bail-type handle 120 described in more detail below.

The sidewalls 54 of the container 50 merge into an integral neck 66 as shown in FIG. 6. The neck 66 includes a vertical portion 70 which has a wide mouth opening. The neck 66 has a diameter which is less than that of the container 50 at its sidewalls 54. The sidewalls 54, at the top portion 86 which is intermediate the sidewalls 54 and the neck 66, may be rounded for strength and to produce a smooth junction between the sidewalls 54 and the neck 66. Similarly, the corners 74 at the junction of the sidewalls 54 in the top portion 86 are also rounded. Although rounded, the corners may be sharply angled to maximize the volume capacity of the container. One or more of the corners 74 may also be recessed relative to the other sidewall dimensions, as previously discussed, to allow for appropriate clearance for a paint stream as it is poured from the container 50 or a spout 160. As the diameter of the neck 66 is somewhat smaller then the width of the container 50, a horizontal portion 68 is provided between the neck 66 and the sidewalls 54, spanning the distance between a vertical portion 70 of the neck 66 and the top of the sidewalls 54. The length of this horizontal portion 68 varies, depending upon the difference between the width between opposite sidewalls 54 of the container 50 and the diameter of the neck 66 at its vertical portion 70.

Figure 22:
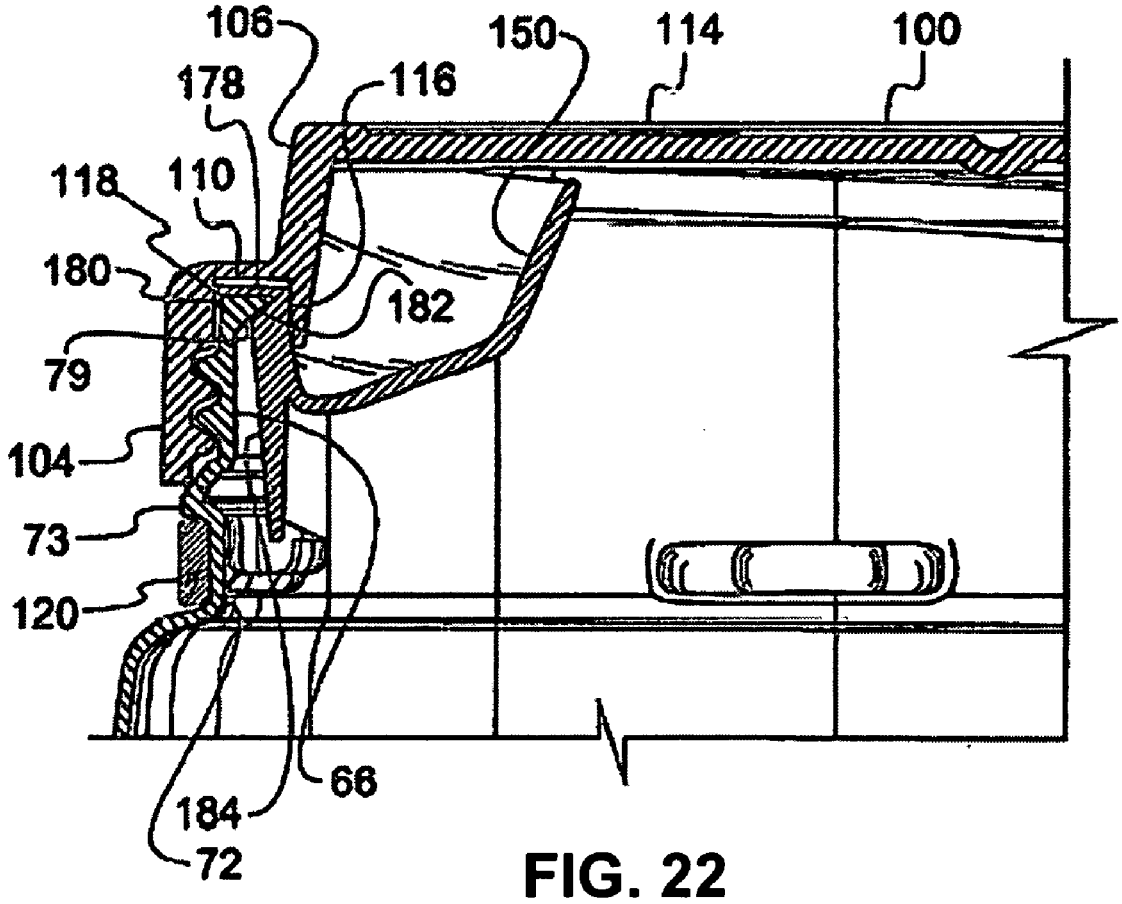
FIG. 22 shows a cutaway view of an insert and lid secured in place on a container.

The vertical portion of the neck may include a physical or imaginary "fill line" for liquid placed within the container 50. In a rectangular embodiment of the container 50, the fill line for 128 ounces of fluid is located less than one inch from the top of the neck, and preferably approximately 0.77 inches from the top of the neck 66. The fill line for 131 ounces of fluid, the theoretical maximum coating material and pigment amounts required to create any shade of tinted material, is preferably approximately 0.56 inches from the top of the neck 66. The vertical portion 70 of the neck 66 also preferably includes a bail seat 72. The bail seat is a portion of consistent vertical diameter on the neck 66 and onto which a bail type handle 120 may be attached. As shown in FIG. 22, the bail seat may be bordered on its top side by a lip 73. The lip 73 has a diameter which exceeds that of the bail seat 72, thus, allowing the bail handle 120 to snap over the lip 73 into a locked position on the bail seat 72. The bail handle 120 may be snapped into position by manual application of force or by the action of the lid 100 being screwed onto the container 50. A bail handle 120 may rotate freely about its seat 72, as in the embodiment of FIGS. 1 and 2, or may be keyed to the seat for specific alignment on the container body 51, as in FIG. 6. In the fixed bail handle embodiment shown in FIGS. 6, 13 and 15, a tab 122 extending from the bail 120 fits within an indentation 75 on the seat 72 in the neck 66 or vise-versa. Referring back to FIG. 6, the neck 66 includes a threaded surface 76 above the lip 73. The threaded surface 76 may include a single continuous thread to secure and seal the lid 100 into a closed position upon the container 50. In the preferred embodiment, the threaded surface 76 comprises a double helix thread. The double helix thread ensures that the lid 100 begins to engage the neck 66 at a predetermined position, such that when the lid 100 completes its rotations on the neck threads 76 and is tightly sealed, the lugs 108 upon the lid 100 are positioned at a predetermined location. In the preferred embodiment of a lid 100 with two lugs 108, the predetermined location of the two lugs 108 in sealed position is with one aligned over the integral handle 84 and another over a corner opposite the integral handle, as illustrated in FIG. 13.

Figure 32:
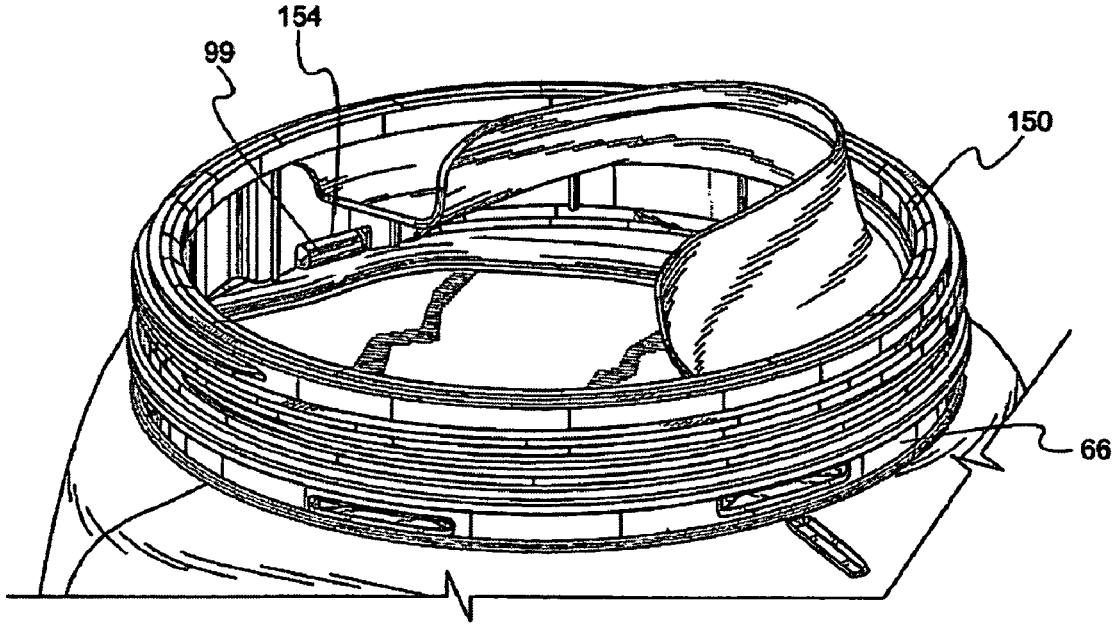
FIG. 32 shows a pouring insert in position within the neck of the container.

Referring to FIG. 21, the interior of the neck 66 of the container 50 may include numerous insert seats 98. The insert seats may be projections extending from the interior surface of the neck 66. The insert seats 98 provide a place for an insert 150 to rest. The neck 66 may also include one or more tabs 99 extending from its inner surface. One tab 99 is designated to mate with a mating notch 154 formed in the insert 150 to help position the insert 150 into a desired orientation as shown in FIG. 32. An embodiment of the neck 66 with more than one tab 99 will only have a single tab 99 which is sized to mate with the notch 154 upon the insert.

Figure 24:
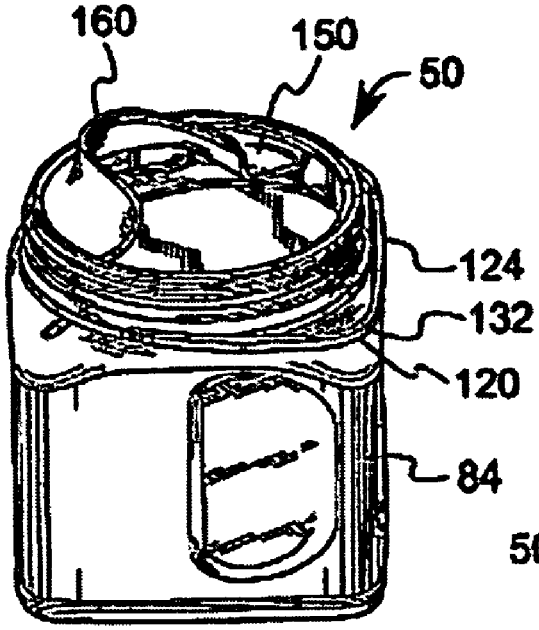
FIG. 24 shows a preferred orientation of an insert with respect to the rest of a container.

FIGS. 7–11 show one type of insert 150 which may be placed within the neck 66 of the container 50. The insert 150 may be manufactured by injection molding from polypropylene. The insert 150 includes an outer wall 152 around the outside which when the insert is in place abuts the inner surface of the neck 66. The outer wall 152 may define a notch 154 in one position along its bottom. This notch 154 mates with the tab 99 of the neck 66, as described above, to align the insert 150 in a desired position as shown in FIG. 24.

Referring back to FIGS. 7–11, in one embodiment of the application, the insert 150 also includes a spout 160. The spout 160 may be formed as part of a web 156 extending across a portion of the insert interior. The web 156, and the radial extension of the spout 160, does not exceed the diameter of the outer wall 152. The height of the spout 160 may, however, extend above the top of the insert outer wall 152. For example, the spout portion extends radially upward from the wide mouth opening by a distance less than the radius of said insert. The spout 160 may be a portion 172 of the interior of the web 156, which is flared upwardly. As the flared portion 172 extends upwardly, it may become more vertical which helps provide a preferred stream profile when liquid within the container 50 is poured. The top of the flared portion 172 of the spout 160 is slightly angled from front to rear to lessen the chance of scraping the spout 160 insert against the underside of the lid 100 when the lid is threaded into engagement on the neck 66 of the container 50.

The spout 160 has an arcuate shape in horizontal cross section. FIG. 9 shows the spout 160 having a preferably "U" shape in horizontal cross section. In one embodiment of the application, the distance from the spout's cusp 174 to an imaginary line between the two rear edges 176 of the spout is approximately 2 to 3 inches or 2.4 inches, and the radius of curvature of the spout 160 at the cusp 174 is approximately 1 inch or about 2.5 cm. The spout 160 may have a narrow diameter of about two inches to restrict undesired large flow rates of paint and to provide a smooth pouring stream. The spout 160 may have rounded rear edges 176 to provide superior strength and minimize interference with a brush being dipped into the container 50. Specifically, a large brush, such as a 4 inch wide or 10 cm wide brush, should be easily permitted access into the container 50 through the spout 160 or other insert 150, into the container interior. As shown in FIGS. 7–11, extending from its top to bottom on its interior surface 158, the spout 160 may be contoured to provide a desired shape to assist in the pouring of paint. The spout 160, at its cusp 174, has a small thickness of approximately 0.03 inches (0.76 mm) to prevent excessive dripping of a terminated paint stream. Smaller thicknesses become difficult to injection mold. As shown in FIG. 10, extending from its top to bottom on its exterior surface, the spout 160 may be contoured to provide a desired shape for draining paint or other coating material back to the interior of the container 50 following the pouring process. The spout 160, in this regard, works in conjunction with a flowback channel 164 within the web.

The flowback channel 164 extends from the base of the spout 160 to the inner wall 151 of the insert 150. The flowback channel 164 may completely surround the spout 160 and is outside of, and beneath the spout 160. The flowback channel 164 may have a curved base. Within the web 156, the flowback channel 164 may be pitched from a higher position at the front to a lower position at the rear of the web to 156 ensure that following pouring, the liquid within the flowback channel 164 is returned to the container interior.

In another embodiment of an insert, as shown in FIG. 12, the insert 150 may include a flat upper surface 166 which defines a multi-functional opening. A forward pouring section of the opening functions as a spout 160'. This spout 160' embodiment does not extend upward from the insert upper surface 166. A transverse section of the opening functions as passage for entry of a brush. The flat backwall 167 of the transverse portion of the opening can be used to wipe a portion of paint off a dipped brush. A rear portion of the opening functions as a stirring stick scraper 162. The rear portion of the opening is very narrow and is oriented transversely from the section allowing passage of the brush.

Figure 14:
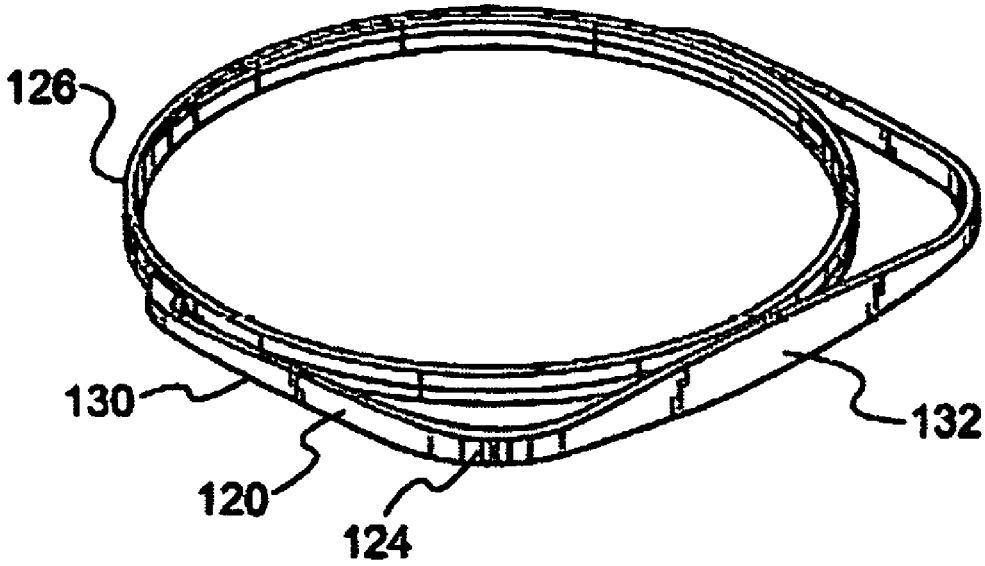
FIG. 14 shows a perspective view of an embodiment of a one-piece bail-type handle detached from a container.

Referring to FIG. 13, a handle, also referred to as a bail or bail-type handle, 120 may be used to lift the container 50. The bail 120 may be manufactured by an injection molding process, of materials such as polyethylene. The bail 120 includes an arcuate member 124 which may be directly affixed to the neck 66 of the container 50 or affixed to a hoop 126. The hoop 126 and arcuate member 124 may be formed from a single piece of polymer or multiple pieces. In a single piece embodiment, shown in FIG. 14, the arcuate member 124, in a non-lifted state, rests generally parallel with the major plane of the hoop 126. The single piece embodiment may be manufactured from medium density polyethylene (MDPE). As the bail 120 is lifted, the arcuate member 124 twists near the joint with the hoop 126, and becomes generally perpendicular to the hoop 124. The hoop 124, which may be manufactured from high density polyethylene in a multi-piece embodiment, circumscribes the neck 66 of the container 50 and abuts the bail seat 72 as described above.

Figure 15:
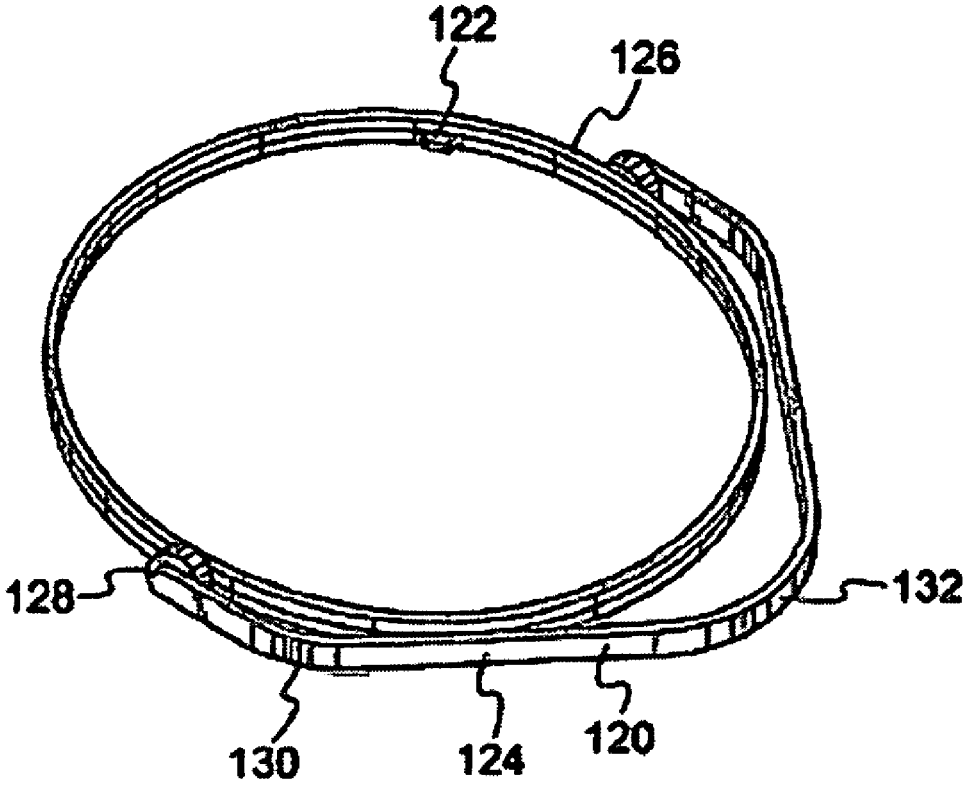
FIG. 15 shows a perspective view of an embodiment of a two-piece bail-type handle detached from a container.

In a multiple piece embodiment, shown in FIGS. 13 and 15, a socket and disc joint 128 may join the arcuate member 124 to the hoop 126. The arcuate member 124 may have a continuous variable cross section and may be manufactured from low density polyethylene for comfort. The arcuate member 124, although integrally formed, may include a plurality of different shaped subsections 130. These subsections 130 may be curved and/or straight. The arcuate member 124 may include a central subsection 132 which may be flat or may be curved. In a preferred embodiment, the central subsection 132 is wider and thicker than the remaining subsections 130. The central subsection 132 may also be rounded on its underside to provide comfort during manual lifting of the container 50. When the central subsection 132 is arcuate, the bail handle 120, when extended such that the container 50 is hung from an object or carried by a user, easily centers itself with respect to the object to provide stability to the hanging container 50. The central subsection 132 may also be oversized with respect to the rest of the bail handle 120 to provide comfort during carrying by hand.

The arcuate member 124 of the bail 120 may be free swinging or may toggle over an edge of the neck 66 of the container or a lug 108 on the container lid 100. This toggle feature prevents undesired swinging of the bail 120. Also in a separate embodiment of the application shown in FIG. 13, the arcuate member 124 of the bail 120 may be locked in lowered position by one or more lugs 108 upon the lid 100 or may be free to swing over and around the lugs 108. The socket and disc 128 of the bail 120 may be shaped to provide a preferred resting point along a path of swing, such as a position where the arcuate member is raised directly vertical. The arcuate member 124 and hoop 126 may be two separate pieces easily snapped together at the disc and socket joint.

The bail 120 may preferably be sized to have a maximum width which does not exceed the width from sidewall to sidewall within a rectangular embodiment of the container. Similarly the bail 120 may preferably be sized to have a maximum width which does not exceed the diameter of the sidewall in a cylindrical embodiment of the container.

Figure 16:
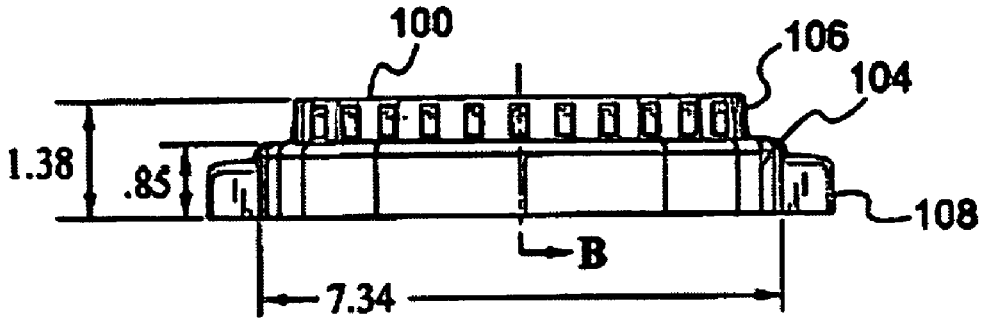
FIG. 16 shows a side view of a container lid in accordance with a first embodiment of the present invention.
Figure 17:
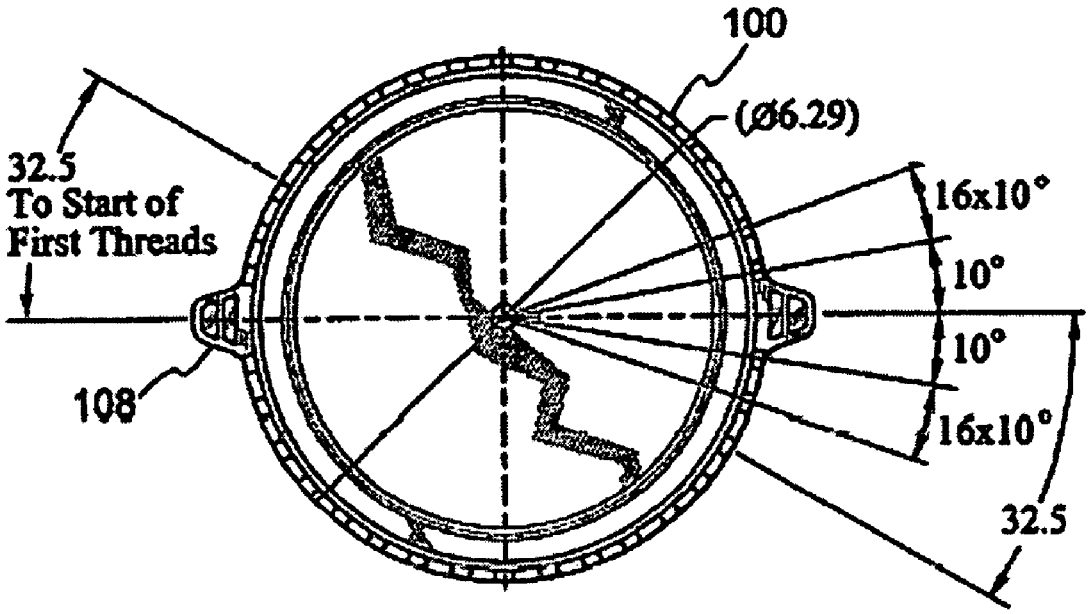
FIG. 17 shows a bottom view of a container lid in accordance with a first embodiment of the present invention.
Figure 18:
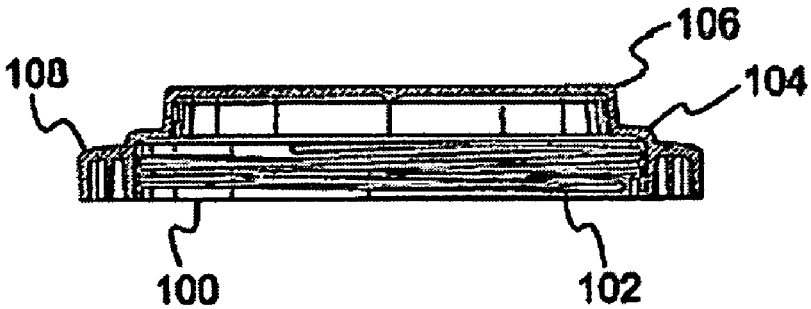
FIG. 18 shows a cutaway view of a container lid in accordance with a first embodiment of the present invention.
Figure 30:
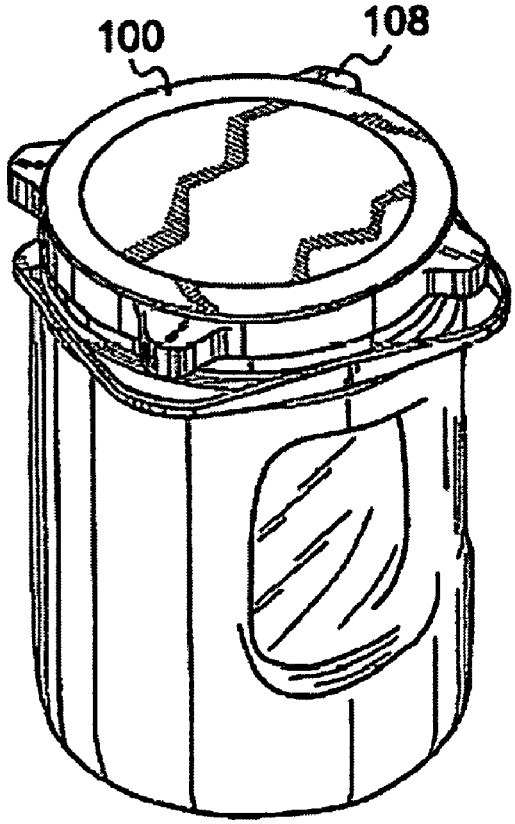
FIG. 30 shows a container with an alternate lid embodiment.
Figure 31:
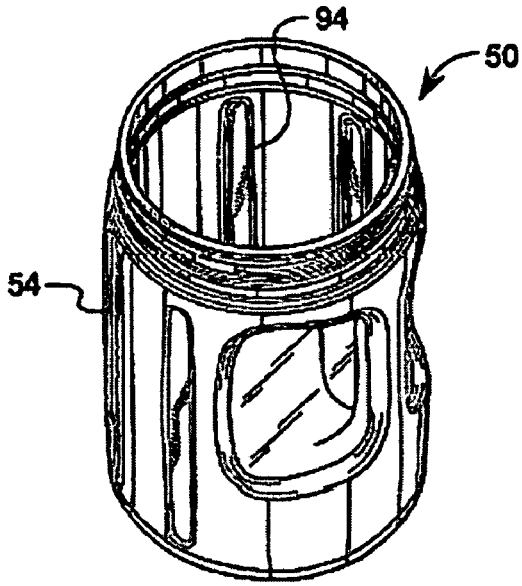
FIG. 31 shows a container with internal ribs.
Figure 36:
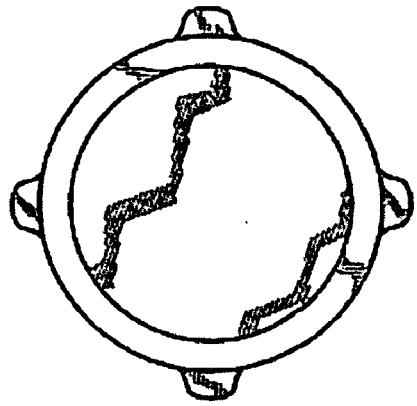
Figure 35:
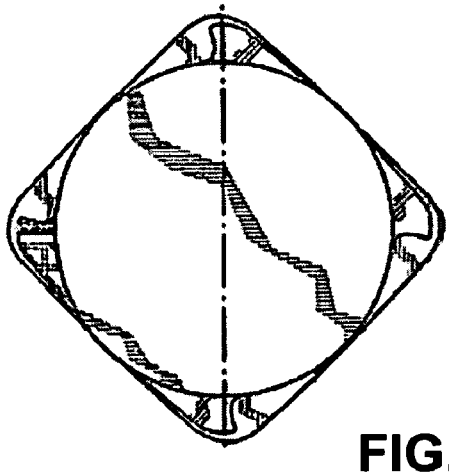

Referring to FIGS. 16–18 a lid 100 may be shown which is engaged with the threads 76 on the neck 66 of the container 50. The lid 100 may be formed by an injection molding process, and manufactured from materials such as polypropylene. The lid 100 may have a substantially flat surface, as shown in FIG. 2, or a stepped top surface having raised gripping ribs as shown in FIGS. 16–18. In the FIGS. 16–18 embodiment, a lower section 104 and an upper section 106 are provided. The upper section 106 provides clearance for the spout 160 of the insert. The side of the upper section 106 mates with the bottom wall 52 of an adjacent container 50 for stability in stacking as previously stated. The upper section 106 may have a diameter which is less than the lower section 104. The lower section includes 104 a plurality of lugs 108 extending radially outwards from an exterior surface. The lower section 104 may include interior threads 102 which communicate and mate with the double helix threads 76 on the neck 66 of the container 50. As previously stated these threads 102 may be in a double helix to enable precise positioning upon tight or sealing engagement of the lid 100 on the container neck 66. The preferred embodiment of the lid 100 includes two lugs 108. An alternate embodiment includes four lugs 108 as shown in FIGS. 30 and 35–36. The lugs 108 may be evenly spaced about the circumference of the lid.

Figure 3:
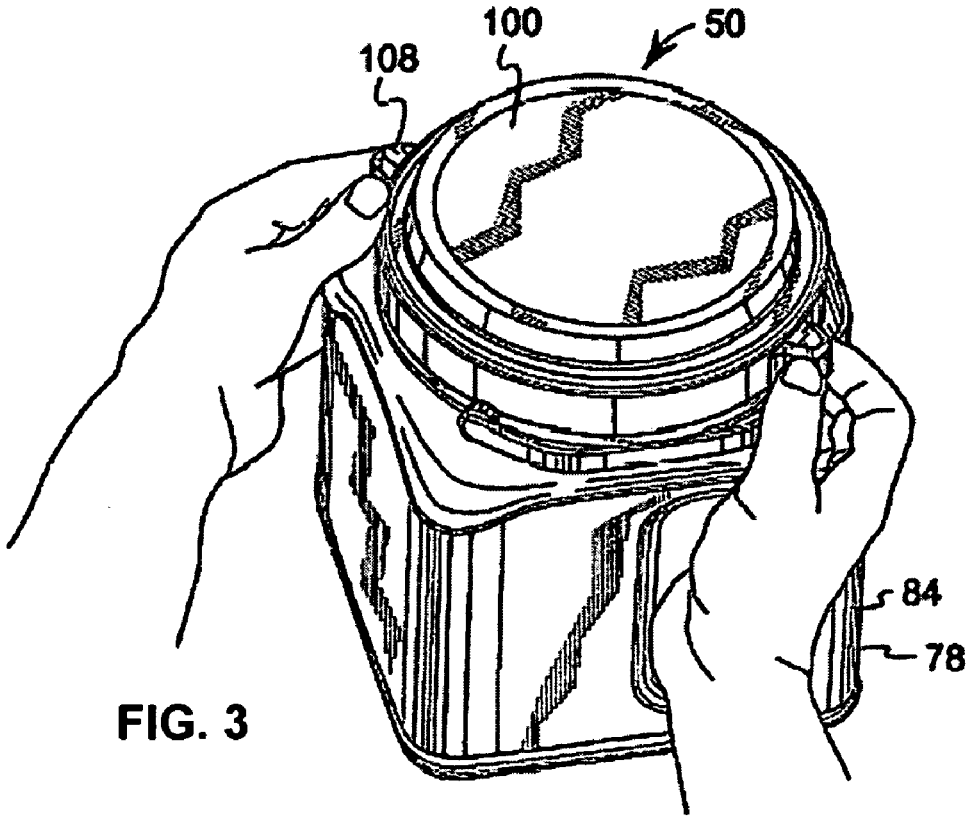
FIG. 3 shows a second "no-tool" method of lid removal from a container.

FIG. 2 illustrates the hand opening of the container using the lugs 108 on the lid 100. By providing a container 50 with a lid 100 that can be opened by hand, no tools are required, which in a conventional metal paint can are typically required, and also have a tendency to damage the paint can during opening. Thus, the container 50 and lid 100 assembly of the present application provide for "no-tool" opening. In a closed position, a lug 108 upon the lid of the container may be within the reach of a user's thumb who is grasping the integral handle 84 of the container 50. The lugs 108 also are within the width of the sidewalls of the rectangular container when the lid 100 is in a sealed position, although the lugs 10 may exceed the width of the sidewalls during application or removal of the lid 100. By sweeping his or her thumb in different directions, the user may apply force to either side of the lug 108 and in doing so open or seal closed the container lid 100. This method is equally effective when the integral handle 84 is grasped with either the user's left or right hand. When additional force is required, both of the user's hands may be laid upon opposite corners of the container 50 as shown in FIG. 3. The desired corners are aligned with the lugs 108 upon the lid 100. Force is applied to the lugs 108 by the thumb upon one of the user's hands and the finger upon the opposite hand to remove or seal the lid into place. In a desired embodiment, the lid 100 may be moved from a sealed position by rotation of between one half and three quarter turns or revolutions to a position where removal is possible.

As shown in FIG. 22, a horizontal seat 110 extending between the base of the upper section 106 and the top of the lower section 104 provides a resting place and sealing point for an insertable elastomeric or flexible seal 62 which may be used in the same embodiment of the application. The seal may compress against a flat surface upon the insert 150. The exterior surface of the upper section may include a plurality of ribs 112 as shown in FIG. 16. These ribs 112 make gripping the lid easier. The smaller diameter of the upper section 106 provides a gripping space for an individual with a smaller hand. The ribs 112 also provide mold release advantages in manufacturing. The top 114 of the lid 100 may include a recess to receive a label.

Referring to FIG. 20 another variation of handles 250 used to hold the container 50 of the present application is shown which includes handle indentations 250 on adjacent sidewalls 54 of the container. The handle indentations 250 do not join with each other to form a cavity, which exists in other handle embodiments previously described. The handle indentations 250 may include ridges or other types of texturing to increase gripping properties. As shown, the handle indentations 250 may have a rectangular shape with height exceeding width.

Referring to FIG. 21, the orientation of the integral handle 84 to the wide mouth opening is shown. At this diameter, the wide mouth opening is at least 80% as large as the distance between opposite side walls of the container, and is preferably at least 83% as large. The interior wall 82 defining the cavity portion of the integral handle 84 is vertically aligned within, and thus extends into, the wide mouth opening.

Referring to FIG. 22, a detailed cutaway view of a pinching lock mechanism is shown between the neck 66 of the container and the insert 150. The insert 150 includes a cantilever section 178 with a hooked end 180. The insert 150 also includes a beveled section 182 adjacent to the cantilever section 178. The cantilever section 178, in combination with the beveled section 182 of the insert 150 functions to lock the insert 150 into place over and around the neck of the container. In operation, the insert 150 which is initially detached from the neck 66 may be placed within the opening defined by the neck 66. A portion of a tapered surface 184 of the insert 150 makes contact with a portion of the top of the neck 66. As the insert 150 is forced downward, the tapered surface 184 of the insert 150 slides along a portion of the top of the neck 60 until the beveled section 182 of the insert 150 is reached. Simultaneously, the beveled section 182 of the insert 150 finds the interior beveled section 79 of the neck 66 and the cantilever section 178 of the insert 150 with its hooked end 180 closes over the top of the neck 68. The insert 150 is then locked in place until it is forcefully removed.

The lid 100 contributes to formation of a seal which prevents spillage or drying out of the paint or other coating material within the container 50. To assist in forming a seal, the lid 100 may include an inner ring and lateral sealing surface. The inner ring 116 extends downwardly from the interior side of the lids 100 upper section 106. The lateral sealing surface may be located above the threaded section of the lid. As the lid 100 is screwed onto the neck 66, the inner ring 116 and lateral sealing surface together squeeze the insert 150. The lateral sealing surface 118 abuts the hooked end 180 of the cantilever section 178 and the inner ring 116 abuts the top of the insert 150.

Figure 23:
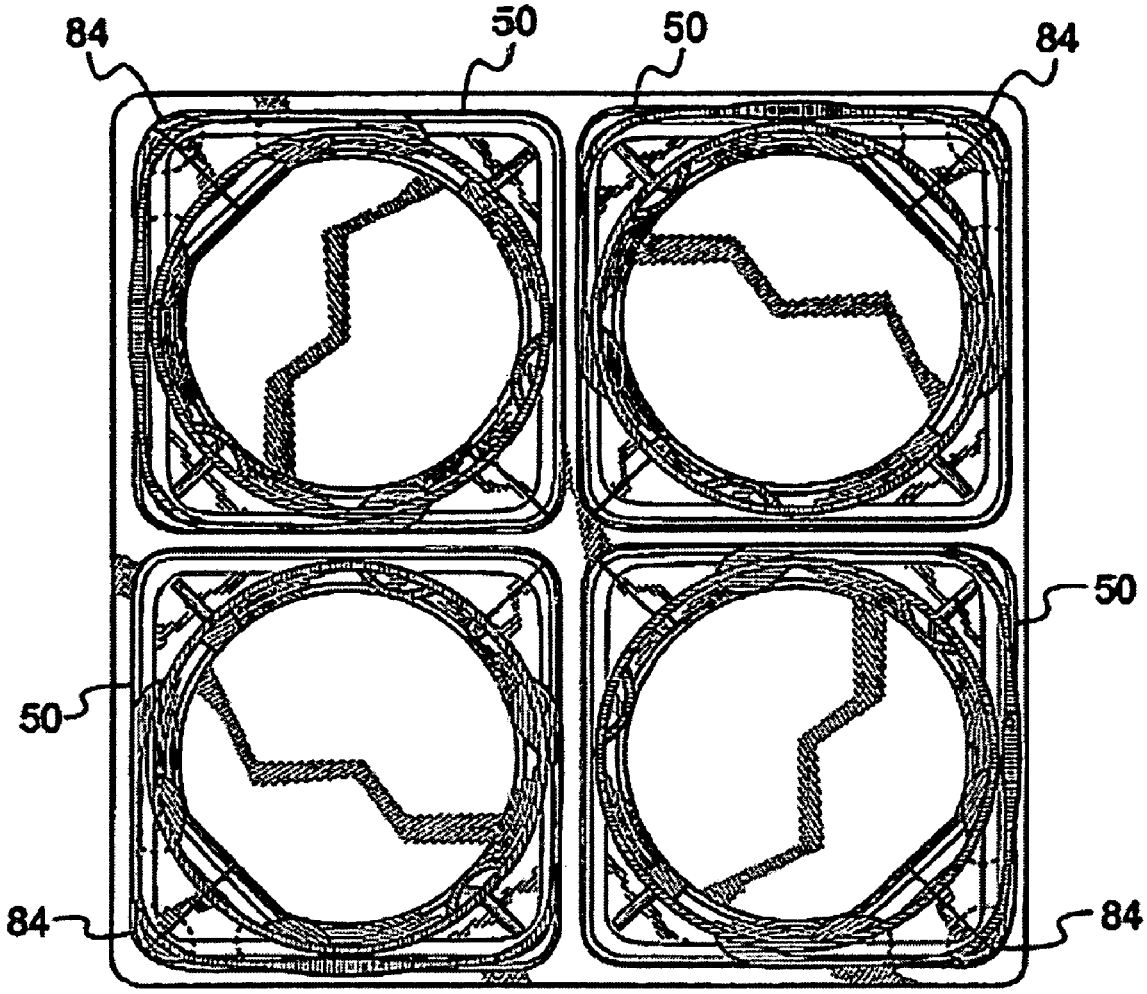
FIG. 23 shows a method of arranging multiple containers.

Referring to FIG. 23, a method for stacking the containers 50 of the present application is shown. The method includes placing four or more containers 50 upon a support such as a pallet or within a box. The containers are placed such that their integral handles 84 are oriented towards the exterior of the support. This orientation provides strength against impacts against the side of the group of containers and strength on the exterior which aides in stacking. A second support and a second set of at least four containers 50 may then be placed within a box upon the top of the first set of boxed containers in the same orientation. In practice, three additional levels of four boxed containers may be added to a single pallet. In practice, a second pallet of up to five levels of containers may be placed on top of the first pallet. The container handle orientation allows the individual containers to be easily removed from a stack formed from multiple pallets and sets.

Figure 28:
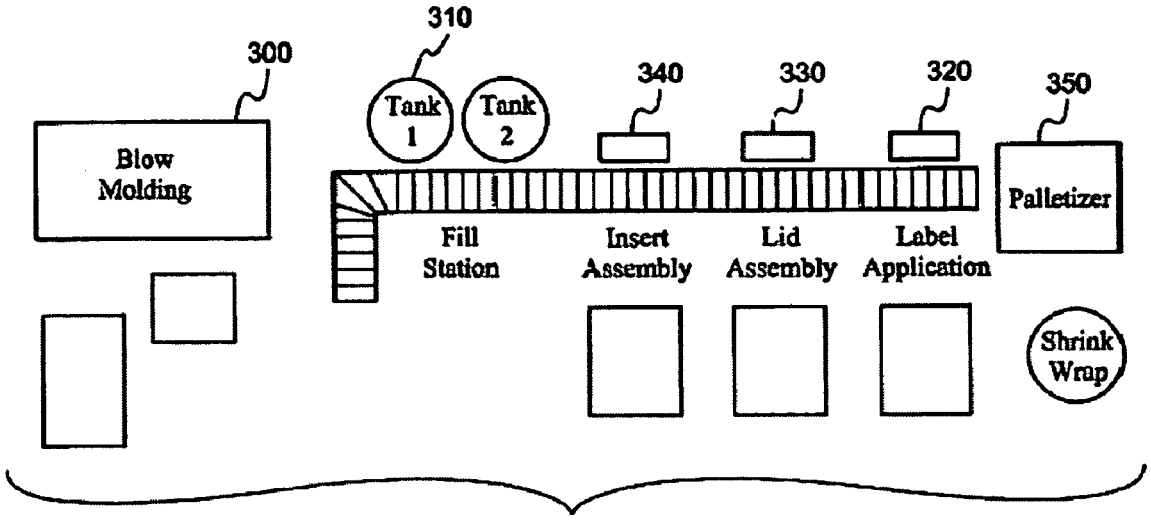
FIG. 28 shows a schematic diagram of a manufacturing system for manufacturing, filling, and additionally preparing the container of the present application for shipment or storage.

Referring to FIG. 28, the container of the present application may be fabricated and assembled in a compact area of a manufacturing facility or in side by side manufacturing facilities. In a preferred method, a fabrication machine, typically a blow molding machine 300, is located in close proximity to paint mixing and filling machines 310. A benefit to this layout is that large container parts do not need to be stored or shipped from facility to facility. In one method of manufacture, a molding facility is located directly next to a paint formulating facility and molded container parts are transferred through a passage in a wall from the former to the latter. Final preparation machines such as label applicators 320, lid assembly 330 and application machines, assemblers 340 and palletizers 350 may also be located within close proximity. The application and assembly operations may be performed in any order.

Figure 37:
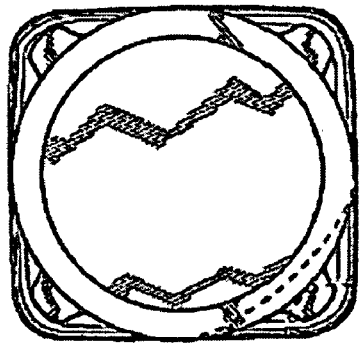
Figure 38:
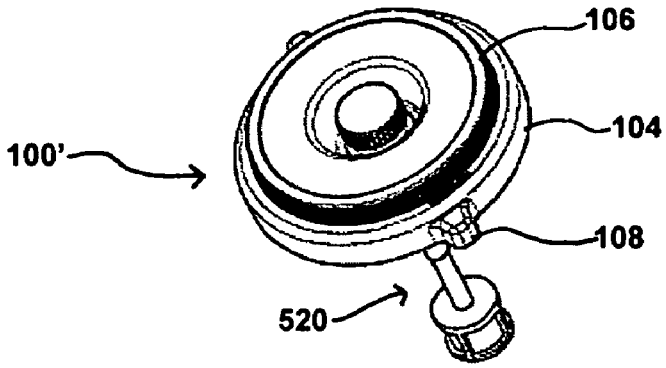
FIG. 38 shows a perspective view of a lid assembly for accommodating paint applicator accessories in accordance with the present invention.
Figure 39:
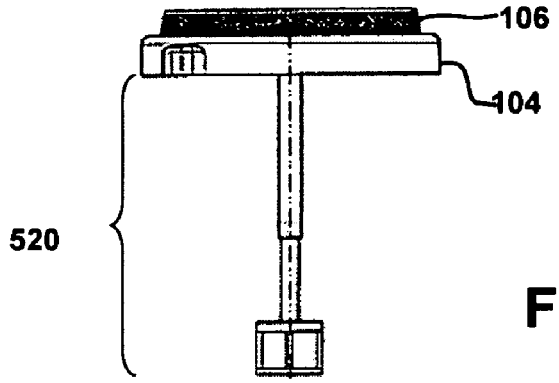
FIG. 39 shows a side view of a lid assembly for accommodating paint applicator accessories.
Figure 40:
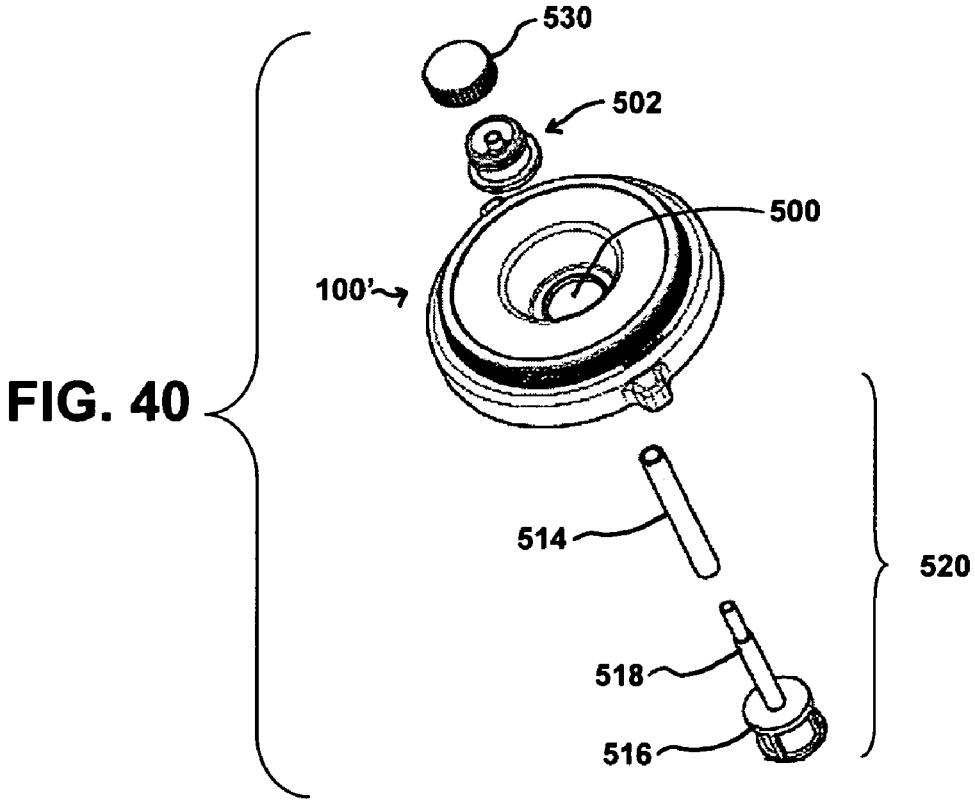
FIG. 40 shows an exploded view of a lid assembly for accommodating paint applicator accessories.
Figure 41:
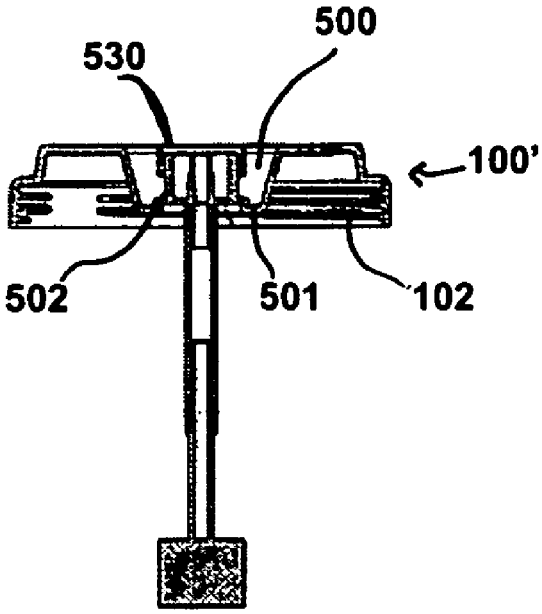
FIG. 41 shows a side cross-sectional view of a lid assembly for accommodating paint applicator accessories.
Figure 42:
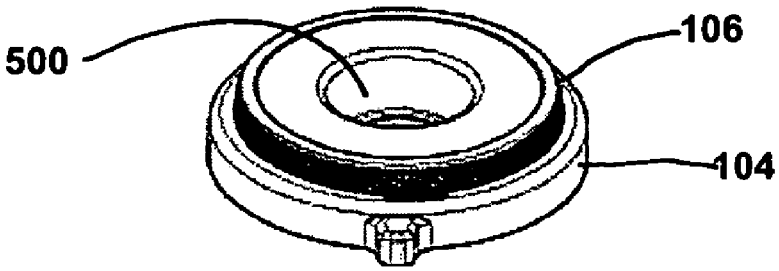
FIG. 42 shows a perspective view of a lid in accordance with a second embodiment of the present invention.
Figure 43:
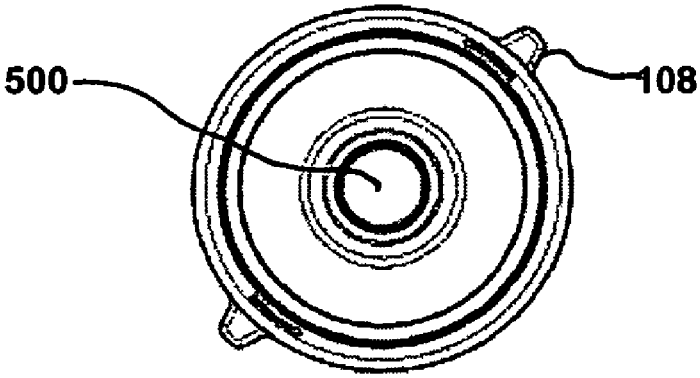
FIG. 43 shows a bottom view of a lid in accordance with a second embodiment of the present invention.
Figure 44:
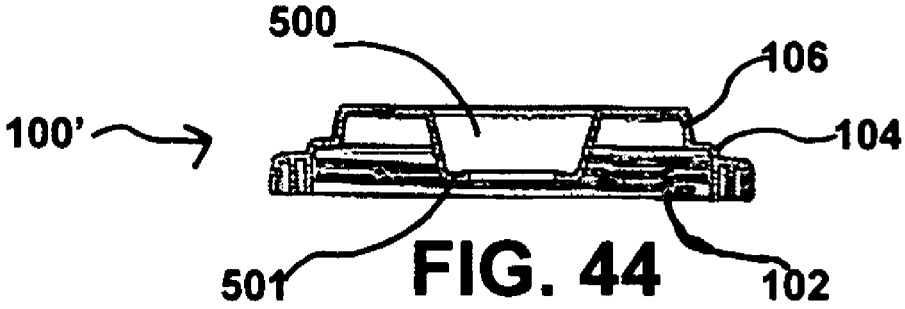
FIG. 44 shows a side cross-sectional view of a lid in accordance with a second embodiment of the present invention.

FIG. 24 shows a container assembled having a preferred alignment of the insert 150. The spout 160 of the insert 150 is oriented opposite the integral handle 84. The bail handle 120 is oriented such that when the arcuate member 124 is lowered, the central subsection 132 may rest directly above the integral handle 84. As shown in FIGS. 13 and 37, the lugs 108 upon the lid 100 are oriented such that a lug 108 is directly above the container corner including the integral handle 84 when the lid is sealed on the container. Thus, all aspects of the illustrated embodiment are properly aligned for ease of shipping and use of the container and lid assembly by consumers.

Figure 25:
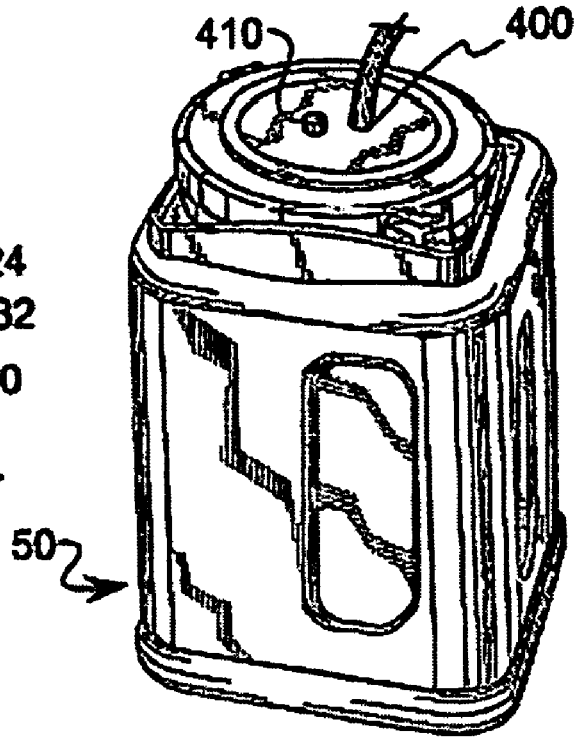
FIG. 25 shows a container with a vented lid.
Figure 26:
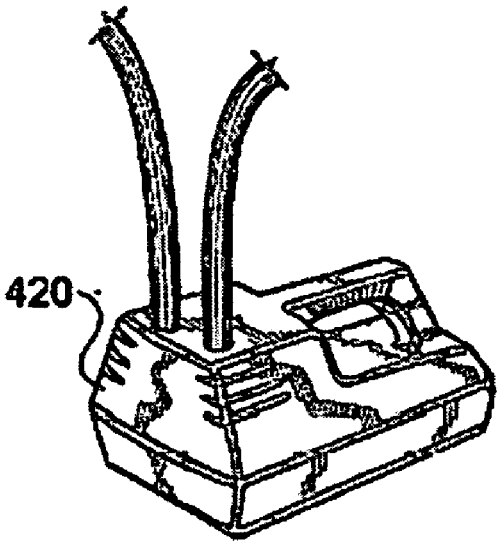
FIGS. 26 and 27 show accessories used with a container of the present invention.
Figure 27:
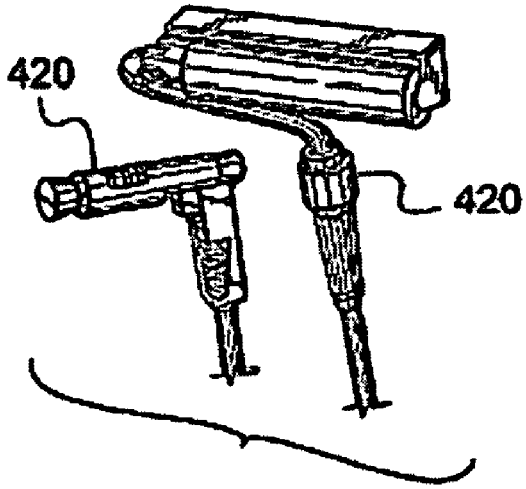

Referring to FIGS. 25, 26 and 27 an embodiment of the application is shown with the container lid 100 including a hole 400 and vent 410 combination. The hole 400 may be normally plugged and opened when the liquid within the container 56 is to be used with an accessory or auxiliary device 420, for example, as a paint sprayer. The vent 410 also may be normally closed, but opened when the hole 400 is unplugged. The vent 410 allows air to enter the container 50 to replace liquid withdrawn, for example, under a vacuum, by an accessory 420 during painting or other operations.

A variation of the concept shown in FIGS. 25–27 is shown in FIGS. 38–51. This embodiment comprises a modified lid and suction assembly for use in withdrawing paint from the container by an applicator device. Referring to FIGS. 38–44, a modified container lid 100' is provided. The modified container lid 100' is substantially similar in structure and function as the lid described above with reference to FIGS. 16–18. However, in this embodiment, the lid 100' has a recess 500 in the center thereof. The recess 500 extends from the upper section 106 of the lid to the lower section 104 of the lid and forms an opening therethrough. In one useful embodiment, the recess opening 500 is wider at the upper section 106 of the lid and is narrower at the lower section of the lid. In one embodiment of the present invention, a lip 501 extends inwardly around the bottom portion of the recess opening.

Figure 45:
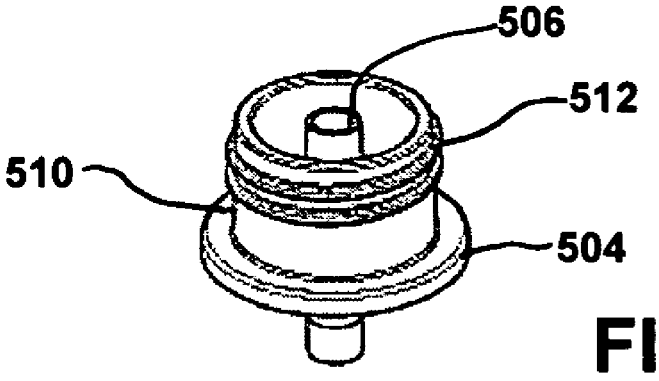
FIG. 45 shows a perspective view of a vent assembly in accordance with one embodiment of the present invention.
Figure 46:
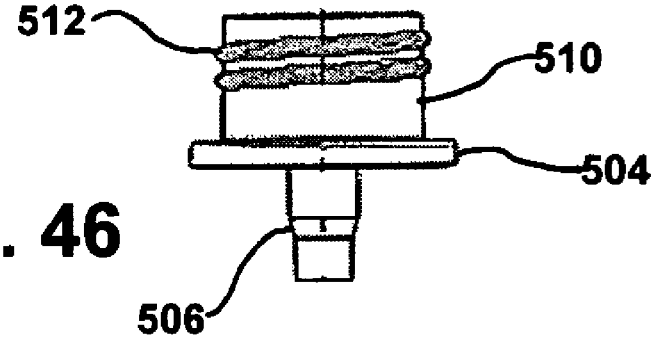
FIG. 46 shows a side view of a vent assembly in accordance with the present invention.
Figure 47:
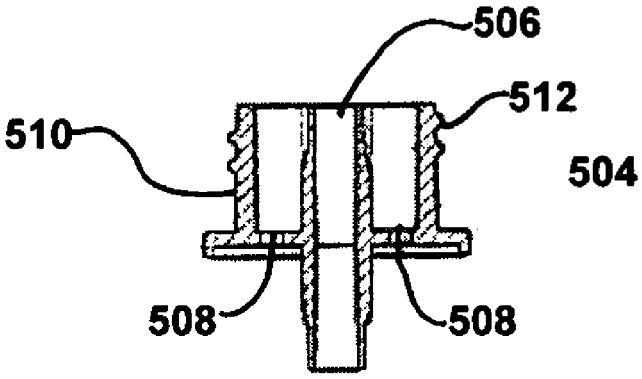
FIG. 47 shows a side cross-sectional view of a vent assembly in accordance with the embodiment shown in FIG. 45.

The modified lid/suction assembly also includes a nozzle device 502. The nozzle device 502 is configured to fit and be secured inside recess 500. In the embodiment shown in FIGS. 40 and 45–48, the nozzle assembly 502 is substantially cylindrical. The nozzle assembly 502 comprises a base 504, an upwardly extending wall 510, a fill tube 506, and one or more vent holes 508. As shown in FIGS. 45–47, a cylindrical wall 510 extends upwardly from the base. In one embodiment, the diameter of the base 504 is at least somewhat larger than the diameter of the upwardly extending circular wall 510 such that the edges of the base 504 extend outwardly at least a short distance beyond the wall(s) 510. The nozzle assembly 502 and its components may be constructed of any material suitable for use the container and lid described herein and with various paint applicators, including a variety of metal and plastic materials.

In one embodiment, the nozzle device 502 is positioned in said recess so that the outer edge of the base 504 rests on the lip 501. The nozzle assembly may be fastened within the lid recess 500 by any known means. In one embodiment, ultrasonic welding is used to secure the nozzle 502 to the lid 100'. In another embodiment, the base 504 may have threads around the outer circumference thereof. In this embodiment, the inner surface of the lower section of the recess 500 would have threads configured to mate with the threads on the nozzle base 504.

A fill tube 506 extends through the base 504. The fill tube 506 is open at both ends and extends both upwardly and downwardly from the base 504. In the embodiment shown, the fill tube 506 extends upwardly from the base 504 approximately the same distance as the circular wall 510. Also, the fill tube 506 extends downwardly from the base 504, so that when the lid and suction assembly are positioned on a paint container, for example, as shown in FIG. 3, the fill tube 506 will extend downwardly at least a short distance into the container neck 66 and/or body 51.

Figure 48:
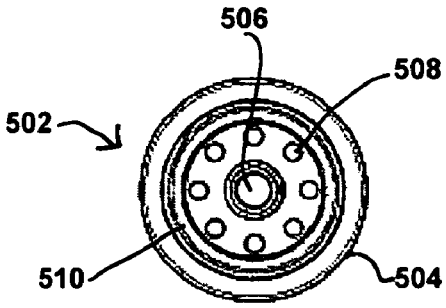
FIG. 48 shows a top view of a vent assembly in accordance with a second embodiment of the present invention.
Figure 50:
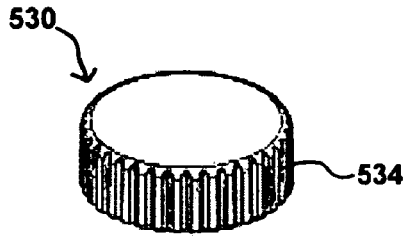
FIG. 50 shows a perspective view of a cap used with the lid assembly.
Figure 49:
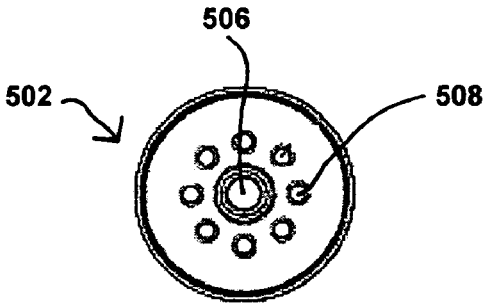
FIG. 49 shows a top view of the vent assembly in accordance with the embodiment shown in FIG. 48.
Figure 51:
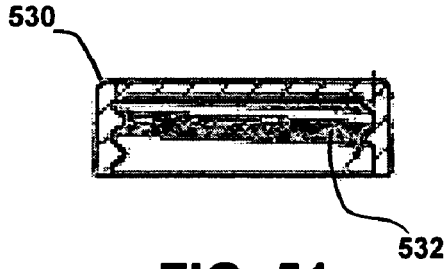
FIG. 51 shows a side cross-sectional view of a cap used with the lid assembly of the present invention.

The base plate includes one or more vents 508. In one embodiment, the base plate includes a plurality of vent holes as shown in FIGS. 48 and 49. As explained below, the vent holes 508 allow air to enter the container to replace a volume of liquid withdrawn from the container by an auxiliary device, such as a paint applicator.

A suction line 520 extends downwardly from the lid 100'. The suction line 520 includes fill tube 506. When the lid/suction assembly is positioned on top of a container, the suction line 520 extends into the container. In one useful embodiment, the suction line 520 is configured to extend far enough into the paint container so that it is capable of removing substantially all of the paint from the container when an auxiliary apparatus is used to withdraw paint from the container.

The suction line may be comprised of a downward extension of the fill tube that is a length sufficient to reach the bottom or near the bottom of a container. In one embodiment, the suction line 520 is comprised of multiple pieces including a suction tube 514. The suction tube 514 is preferably comprised of plastic, such as PVC plastic tubing. The suction tube 514 may extend all the way down to the bottom of the container. However, some applicator devices have very small outlet openings and may become clogged if particles of dried paint or any other solids pass through into the applicator device. To address this issue, a filter 518 may be attached to the suction tube 514 to remove any large solid particles from the paint before it reaches the applicator device. Finally, an intake manifold 516 may be attached to the lower portion of the sprayer filter 518 and be used to facilitate the withdrawal of paint from the container.

As shown in FIGS. 45–47, the circular wall 510 of the nozzle device 502 includes a threaded region 512. The threaded region 512 may include a single continuous thread to secure and seal the cap 530 into a closed position upon the venting/dispensing assembly 502. In another embodiment, the threaded surface 512 may comprise a double helix thread.

The cap 530 is shown in FIGS. 38, 40, and 50–51. The cap is sized to fit over nozzle device 502 to plug both the opening of the fill tube 506 and the vent holes 508 and seal the container for storage. The cap 530 includes interior threads 532 which communicate and mate with the threads 512 on the circular wall of the nozzle device 502. The outer surface of the cap 530 may comprise a plurality of raised gripping ribs 534 to aid in tightening and removing cap 530 from nozzle device 502.

The relative diameters of the recess 500 to the nozzle assembly 502 should be such that the edge of the base 504 extending outwardly beyond the circular wall 510 can engage the lip 501 of the recess, while allowing the cap 530 to be easily secured to and removed from the nozzle 502.

In use, any paint applicator capable of withdrawing paint from a container through a tube can be used in connection with the lid/suction assembly shown in FIGS. 38–51. For example, a paint applicator as described in U.S. Pat. No. 4,732,503 has an intake conduit, which can be attached to the fill tube 506. In such an application, a plunger means in the applicator is pulled outwardly from the reservoir/handle causing a vacuum pressure in the reservoir. The vacuum pressure causes the paint in the container to be sucked into the reservoir. As the paint is removed from the container, the vents allow air to enter the container to replace the withdrawn liquid.

In another example, a pump may be used to siphon paint from the container to an applicator device. For instance, in the device disclosed in U.S. Pat. No. 4,175,300, a pump can be attached to fill tube 506. The pump will take suction through the suction line 520 and fill tube 506. The paint is discharged by the pump through a conduit line in communication with an applicator.

Although specific examples are given above, it should be understood that the apparatus shown in FIGS. 25–27 and/or 38–51 and described herein could be used with a variety of known applicators and sprayers including, but not limited to, internally fed paint rollers or brushes, powered rollers or brushes, airless sprayers, cup-gun type sprayers, diaphragm pump sprayers, piston pump sprayers, air compressor gun sprayers, high volume/low pressure (HVLP) sprayers, and other similar devices.

While the present invention has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the invention, in its broader aspects, is not limited to the specific details, the representative apparatus, and illustrative examples shown and described. Accordingly, departures may be made from such details without departing from the spirit or scope of the applicant's general inventive concept.

What is claimed is:

1. An apparatus for withdrawing paint from a container, wherein the container comprises a neck opening having threads on an outside surface thereof, the apparatus comprising:

(a) a container lid comprising, an upper section and a lower section;

threads on an inner surface of said lower section for mating with the threads on the neck opening of the container;

a recess opening formed in a center portion of said lid, said recess opening extending from said upper section to said lower section and having a diameter that narrows from said upper section to said lower section, and a lip extending inwardly around a circumference of said recess opening proximate to said lower section; and a plurality of lugs extending radially from an outer surface of said lower section of said lid;

(b) a nozzle comprising, a base;

a circular wall extending upwardly from said base, and having threads on an upper portion thereof, wherein said circular wall is positioned at least a short distance inwardly from an outer edge of said base;

a fill tube extending through a center of said base and said circular wall, wherein said fill tube extends upwardly approximately the same distance as said circular wall and extends downwardly at least a short distance from said base;

a plurality of vent holes formed in said base;

wherein said base is positioned inside said recess opening in said container lid such that the outer edge of said base is positioned on said lip;

(c) a suction tube attached to said fill tube and extending downwardly from said container lid; and (d) a cap comprising, threads on an interior surface thereof for mating with the threads on said upper portion of said circular wall;

a plurality of raised gripping ribs on an outer surface of said cap.

2. The apparatus as recited in claim 1, further comprising, a sprayer filter attached to said suction tube and extending downwardly from said suction tube.

3. The apparatus as recited in claim 2, further comprising, an intake manifold attached to said sprayer filter at an end of said sprayer filter opposite said suction tube.

4. The apparatus as recited in claim 1, wherein a combined length of said suction tube, said sprayer filter and said intake manifold is such that when the container lid is positioned on the neck of the container, the intake manifold reaches the bottom of the container.

5. A lid for a plastic container for storing liquid coating materials, wherein said plastic container comprises a body with a bottom wall, at least one sidewall and a neck, wherein the neck defines a wide mouth opening and includes threads for receiving mating threads on the lid, said lid comprising:

threads for receiving mating threads on the container neck;

a plurality of lugs extending radially therefrom and terminating at or before said lugs extend beyond said container sidewall when said lid is in sealed engagement with the container;

a threaded recessed opening;

a dispensing assembly positioned in the threaded recessed opening said dispensing assembly comprising a nozzle, which comprises a base, a cylindrical wall extending upwardly from said base, a fill tube extending through a center of said base, said fill tube adapted to be in fluid communication with the interior of the container, and wherein at least one vent is formed in said base;

a cap adapted to be positioned over the nozzle to seal the fill tube and vent.

* * * * *